US009087659B2

(12) United States Patent
Li et al.

(10) Patent No.: US 9,087,659 B2
(45) Date of Patent: Jul. 21, 2015

(54) OPTICALLY TRANSMISSIVE KEY SWITCH MECHANISM FOR DISPLAY-CAPABLE KEYBOARDS, KEYPADS, OR OTHER USER INPUT DEVICES

(75) Inventors: Ming Li, Singapore (SG); Kok Kiong Low, Singapore (SG)

(73) Assignee: RAZER (ASIA-PACIFIC) PTE. LTD., Singapore (SG)

( * ) Notice: Subject to any disclaimer, the term of this patent is extended or adjusted under 35 U.S.C. 154(b) by 0 days.

(21) Appl. No.: 14/361,652

(22) PCT Filed: Nov. 29, 2011

(86) PCT No.: PCT/SG2011/000422
§ 371 (c)(1),
(2), (4) Date: Jun. 26, 2014

(87) PCT Pub. No.: WO2013/081546
PCT Pub. Date: Jun. 6, 2013

(65) Prior Publication Data

US 2015/0021155 A1 Jan. 22, 2015

(51) Int. Cl.

| | |
|---|---|
| ***H01H 13/70*** | (2006.01) |
| ***H01H 13/10*** | (2006.01) |
| ***H01H 13/14*** | (2006.01) |
| ***H01H 13/83*** | (2006.01) |
| ***H01H 3/12*** | (2006.01) |
| ***H01H 5/02*** | (2006.01) |
| ***H01H 13/04*** | (2006.01) |

(52) U.S. Cl.

CPC ..... *H01H 13/10* (2013.01); *H01H 3/122* (2013.01); *H01H 5/02* (2013.01); *H01H 13/04* (2013.01); *H01H 13/14* (2013.01); *H01H 13/83* (2013.01); *H01H 2215/042* (2013.01); *H01H 2219/044* (2013.01); *H01H 2221/026* (2013.01); *H01H 2221/04* (2013.01); *H01H 2221/058* (2013.01); *H01H 2223/038* (2013.01)

(58) Field of Classification Search
None
See application file for complete search history.

(56) References Cited

U.S. PATENT DOCUMENTS

| | | | | |
|---|---|---|---|---|
| 4,771,146 | A * | 9/1988 | Suzuki et al. | 200/344 |
| 4,950,093 | A * | 8/1990 | Ertl | 400/496 |
| 6,492,978 | B1 * | 12/2002 | Selig et al. | 345/173 |
| 7,199,320 | B2 * | 4/2007 | Sato | 200/341 |
| 7,265,310 | B1 * | 9/2007 | Wang | 200/344 |
| 8,262,480 | B2 * | 9/2012 | Cohen et al. | 463/37 |
| 2006/0256090 | A1 * | 11/2006 | Huppi | 345/173 |

FOREIGN PATENT DOCUMENTS

| | | | |
|---|---|---|---|
| EP | 2056317 | A1 | 5/2009 |
| KR | 10-2008-0094238 | A | 10/2008 |
| KR | 10-2011-0112796 | A | 10/2011 |
| KR | 20-2011-0010790 | U | 11/2011 |

* cited by examiner

*Primary Examiner* — Vanessa Girardi
(74) *Attorney, Agent, or Firm* — Novak Druce Connolly Bove + Quigg LLP

(57) ABSTRACT

Key switch mechanisms are typically used for mediating user input to computing devices. A key switch mechanism provides immediate tactile feedback to a user upon user-actuation thereof. Unlike touchscreen interfaces, existing key switch mechanisms of conventional keyboards do not provide a user with a dynamically changeable interface. Described is a key switch mechanism that comprises a circuit module, a key cap and a linkage mechanism for guiding travel of the key cap substantially along a travel axis. The linkage mechanism comprises a positioning board and a main link pivotably inter-coupling the positioning board and the key cap. The main link substantially impedes tilt of the key cap away from the travel axis during travel of the key cap therealong from a released position, whereat the key cap is biased, to a depressed position whereat a control signal is generated.

10 Claims, 20 Drawing Sheets

OPTICALLY TRANSMISSIVE KEY SWITCH MECHANISM FOR DISPLAY-CAPABLE KEYBOARDS, KEYPADS, OR OTHER USER INPUT DEVICES

TECHNICAL FIELD

The present disclosure relates generally to a key switch mechanism that includes a key cap, a circuit module and a linkage mechanism which includes a positioning board and a set of main links. The key cap includes an optically transmissive portion and with the linkage mechanism, a tactile feedback to a user upon user-effectuated or user-directed actuation or displacement of said key caps can be experienced. The key cap includes a protrusion disposed at a periphery of the said key cap for contacting a switch electronically coupled to the circuit module. By contacting the switch, electronic signals can be activated.

BACKGROUND

Key switch mechanisms are constituents of computer or machine operated devices such as a keyboard. They are conventionally used for facilitating, enabling, or mediating user input to computing devices (e.g., desktop computers and laptops). A key switch mechanism has the function or advantage of providing immediate, or substantially immediate, tactile feedback to a user upon user-actuation of key(s) on the mechanism. A conventional key switch mechanism typically has multiple keys arranged in rows and representing different alphanumeric characters.

A keycap is typically a small plastic cover that is carried by a computer keyboard. Keycaps are conventionally used to indicate or display the alphanumeric character that they correspond to or the function that is associated therewith. Generally, user-effectuated displacement or depression of a keycap results in an actuation of a corresponding key switch that is positioned underneath said keycap. Recently, there are several modifications to keyboards, key switch mechanism, as well as keycaps. For instance, keyboards or key switch mechanisms configured to allow light to shine through specific portions or areas of the keyboards or key switch mechanisms have been developed. The illumination of specific areas, or of specific key caps, on the keyboard can help to distinguish different areas of the keyboard, as well as different key caps on the keyboard, from each other. U.S. Pat. No. 4,449,024 discloses an illuminated keyboard that allows light to shine through specific keycaps. In addition, U.S. patent application Ser. No. 9/755,062 discloses keyboards with keycaps that each has a different transparent alphanumeric designation. Each keycap of the keyboard of U.S. Ser. No. 9/755,062 has an opaque housing and a transparent alphanumeric designation. Light is only transmissible through the transparent alphanumeric designation to thereby enable differentiation between the different keys carried by the keyboard.

A significant drawback or limitation associated with conventional keyboards is the static information, for instance static letters and numbers, that are displayed by individual key caps of said keyboards. Unlike touchscreen interfaces, existing conventional keyboards do not provide a user with dynamically changing interface via which a user can introduce inputs, instructions, and/or commands.

Touchscreen interfaces are becoming increasingly popular. Computers and other electronic products that incorporate a touchscreen, for example the Apple iPhone™, provide users with a relatively more intuitive way of controlling (e.g., providing input to) said computers. In addition, touchscreen interfaces allow programmers to provide customized interfaces, which can be required and/or advantageous with particular applications. However, a common disadvantage associated with conventional touchscreen interfaces is a lack of a robust haptic or tactile feedback to users to confirm user-directed touchscreen inputs.

Haptic touchscreen interfaces (i.e., touchscreen interfaces that provides a tactile feedback to users upon touchscreen inputs) have generated increasing commercial interest. For example, LG© and Samsung© have introduced handsets and mobile phones that incorporate vibration-based haptic feedback systems. However, such vibration-based haptic feedback systems are relatively complex and costly to manufacture, assemble, and/or maintain. In addition, vibration-based haptic feedback systems may not be suitable for rapid and/or short-duration multiple consecutive user-inputs.

U.S. patent application Ser. No. 11/388,224 discloses a lid structure that can be positioned relative to, for instance on the surface of, a touchscreen interface for providing tactile feedback to a user. The lid structure can be shaped and configured to guide a user's finger(s) to a desired position on the touchscreen. However, there are ergonomic disadvantages or issues associated with the lid structure of U.S. Ser. No. 11/388,224. In addition, the lid structure of U.S. Ser. No. 11/388,224 is not robust enough for providing fast and/or accurate tactile feedback associated with specific individual user inputs via the touchscreen.

In addition, U.S. patent application Ser. No. 10/235,162 discloses a touchscreen tactile feedback system. With the touchscreen tactile feedback system of U.S. Ser. No. 10/235,162 a keyboard including keys mechanically interfaces with a touchscreen panel. The keys of the keyboard can be physically displaced by a user for contacting the touchscreen panel and thereby enable user-directed input via said touchscreen panel. The physical displacement of the keys provides the user with a tactile response or feedback associated with the user-directed input.

However, existing touchscreens are generally unable to support, accommodate, or keep up with rapid user actuation or input, for example user-effectuated consecutive actuations of more than 100 actuations or inputs per minute). Therefore, the use of touchscreens may not be suitable for applications in which rapid user actuation or input is routinely necessary and/or desired, for instance for gaming applications.

SUMMARY

One of the objects of certain exemplary aspects of the present disclosure is to address the aforementioned exemplary problems and/or to overcome the exemplary deficiencies commonly associated with optically transmissive key switch mechanisms as described herein. Accordingly, for example, provided and described herein are certain exemplary embodiments of exemplary optically transmissive key switch mechanisms.

According to one aspect of this disclosure, there is provided a key switch mechanism. The key switch mechanism comprises a circuit module, a key cap having a top portion and a side wall extending therefrom, and a linkage mechanism for guiding travel of the key cap substantially along a travel axis between a depressed position and a released position. The linkage mechanism comprises a positioning board spatially displaced from the circuit module, the positioning board defining an aperture shaped and dimensioned for receiving the key cap therethrough; and a main link pivotably coupled to the positioning board, the main link further being pivotably coupled to the exterior of the side wall of the key cap, the main link for substantially impeding tilt of the key cap away from the travel axis during travel of the key cap through the aperture of the positioning board. The circuit module biases the key cap towards the released position and generates a control signal when the key cap is displaced to the depressed position.

In some embodiments, the main link is a rigid wire comprising two ends terminating in corresponding two apertures defined in the side wall of the key cap, the two cavities being shaped and inter-aligned for pivoting of the main link thereabout.

In some other embodiments, the linkage mechanism further comprises a second main link pivotably coupled to the positioning board and the exterior of the side wall of the key cap, the main link and the second main link being in a parallel configuration with the key cap for further impeding tilt of the key cap from the travel axis.

BRIEF DESCRIPTION OF THE DRAWINGS

Embodiments of the disclosure are described hereinafter with reference to the following drawings, in which.

DETAILED DESCRIPTION

Figure 1A:
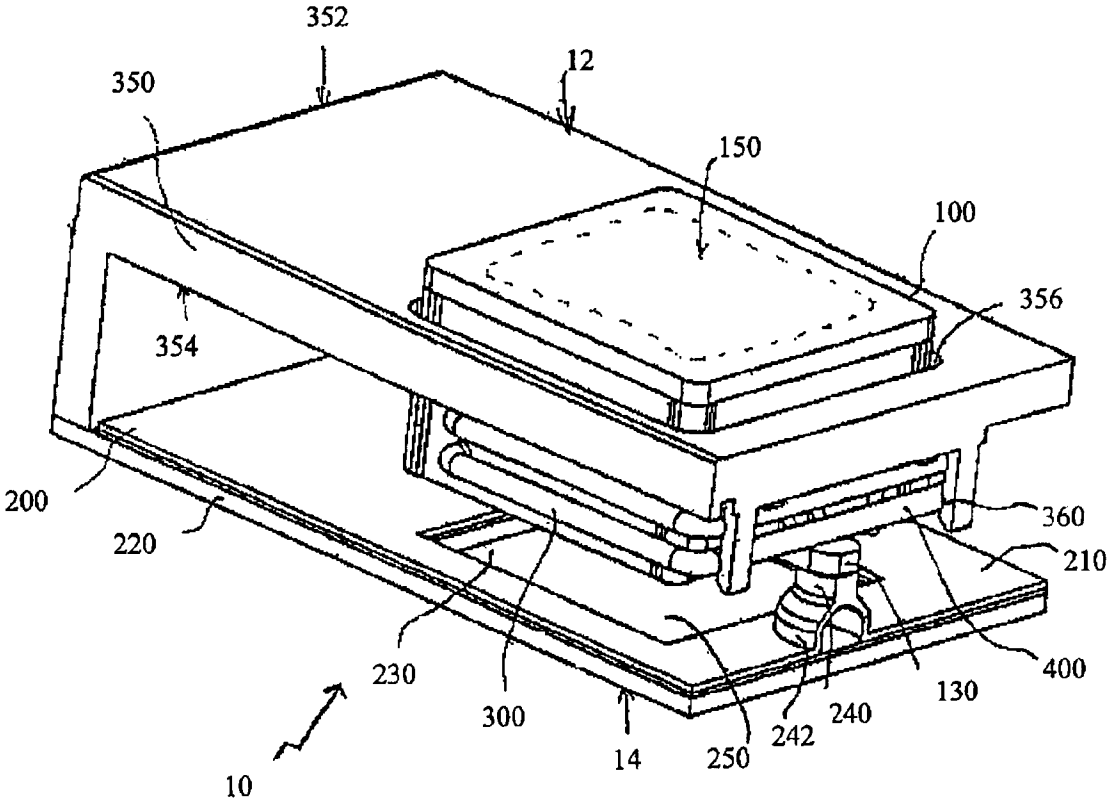
FIG. 1A shows a key switch mechanism comprising a key cap, a circuit module and a linking mechanism comprising a positioning board and a set of main links.

Embodiments of the present disclosure relate to a key switch mechanism that includes a key cap, a circuit module and a linking mechanism comprising a positioning board and a set of main links. The key cap includes a top end and a side wall extending therefrom. The key cap further includes an optically transmissive portion or region (also known as a light permeable or transmissive portion or region). The positioning board which is spatially displaced from the circuit module is shaped and dimensioned for receiving the key cap therethrough. The set of main links is pivotably coupled to the positioning board. The linking mechanism is configured for providing a tactile feedback to a user upon user-effectuated, user-controlled, or user-directed actuation or displacement of the key cap.

The key caps include a protrusion extending from the side wall away from the interior thereof. The protrusion is positioned or disposed at a periphery or perimeter of the key cap, for example along a side or edge of or at a corner of the key cap, or at a distance away from the key cap. The key caps can be coupled to, carried by, assembled or arranged onto, disposed relative to or across, or used with an optically transmissive surface or screen (or an optical display screen or surface). The optical display screen can be a rigid display screen, for example an LCD or LED based screen, or a flexible display screen, for example a polymer based screen configured as an organic LED (OLED) screen. The key caps can also be coupled to, carried by, assembled or arranged onto, disposed relative to or across, or used with a positioning board that carries or supports the key caps.

Each key cap, more specifically the protrusion of each key cap, can correspond to one actuator of the circuit module. The actuator is coupled to a switch which is electrically coupled to an electronic circuitry of the circuit module. Displacement of a particular key cap relative to said key cap's corresponding switch by way of the actuator can trigger, effectuate, or cause an activation or actuation of said switch. Activation or actuation of said switch can result in generation of electrical signal(s) by said switch. The generated electrical signal(s) are transmissible to an electronic or computing device (e.g., a desktop or laptop computer, a gaming console, or a mobile phone) coupled to the electronic circuitry of the circuit module.

In multiple embodiments, the key cap, more specifically the top side of the key cap includes or incorporates the optically transmissive (or light permeable) surface, portion, area, or window. The optically transmissive or light permeable surface, region, portion, area, or window can be referred to as a viewing area or a viewing window (e.g., an image viewing area or an image viewing window). Where the key cap is disposed or positioned adjacent or relative to, more specifically on top of or over a light-emitting surface (e.g., a display screen or surface such as a LCD screen), the light permeable portion or surface of the key cap allows transmission of light emitted from the light-emitting portion or surface, more specifically from the portion or area of the light-emitting surface corresponding to the light permeable portion or surface of the key cap, therethrough. The transmission of light through the light permeable portion or surface of the key cap allows a user to view or see images (e.g., icons, figures, and alphanumeric characters) displayed by the underlying surface (e.g., display screen or surface such as an LCD screen), more specifically by the area of the underlying surface corresponding to the light permeable portion or surface of the key cap.

The key cap, more specifically the protrusion of the key cap is displaceable, for instance relative to the optical display screen or surface. More specifically, the key cap, and hence the protrusion of the key cap can be displaced relative to a corresponding actuator and/or switch. The key cap can be displaced between a first position and a second position relative to the optical display screen or surface, wherein the second position is located in closer proximity to the optical display screen or surface as compared to the first position.

In many embodiments, the set of main links is shaped and/or configured to bias the key cap at the first position (also referred to as a rest position, a rest state, or an original position). The key cap is actuable (e.g., displaceable or moveable) from the first position to or towards the second position (also referred to as an actuated position or an actuated state) by a force applied onto, or transferred to, the key cap. The displacement of the key cap, for example from the first position to the second position, facilitates or effectuates a corresponding displacement of the switch by way of the actuator. In many embodiments, the displacement of the key cap at the second position correspondingly displaces the actuator for facilitating or effectuating actuation of a corresponding switch. For instance, the displacement of the key cap at the second position can effectuate contact between the actuator of said key cap and said key cap's corresponding switch. Such a contact can facilitate or effectuate activation or actuation of said switch and thereby effectuate generation of electrical signal(s) by said switch.

The tactile feedback provided to the user of the key cap upon or during actuation or displacement of said key cap (e.g., displacement from the first position to the second position) can be desirable, advantageous, important, and/or useful, particularly when applied to particular functions (e.g., gaming applications) wherein fast, discernible, easy, and/or accurate feedback, knowledge, and/or confirmation of key actuation is required and/or desired. The immediate, or substantially immediate, feedback, i.e., in the form of tactile sensation or feedback, provided by the key caps of embodiments of the present disclosure can be significantly useful and advantageous to a user's overall gaming experience. The key caps of various embodiments supports rapid consecutive actuations or displacements (e.g., at least 50, 100, 150, or more actuations or displacements per minute) thereof for contacting corresponding switches (e.g., electromechanical switches) and generating electrical signals transmissible to the computing device. This means that the key caps can be associated with a low, or very low, switch actuation latency period or duration, for example a switch actuation latency period or duration of less than approximately 2 ms, 1 ms, 0.5 ms, or less.

In addition, multiple embodiments of the present disclosure provide an ability to configure and/or position the main link and/or protrusion relative to the key cap in a manner such that the area of the viewing window is maximized. This is to say, the protrusion and/or main link can be configured and/or positioned to minimize obstruction or blockage of light transmitted through the light permeable region or surface.

Representative aspects of key switch mechanism, in particular key caps that are configured to provide tactile feedback upon user-effectuated actuation or displacement of said key caps, are described in detail hereinafter with reference to the drawings in which like or analogous elements or process portions are shown numbered with like or analogous reference numerals.

Key Switch Mechanism

FIG. 1A shows a key switch mechanism 10 in accordance with several embodiments of this disclosure. The key switch mechanism 10 can constitute a part of a keyboard or keypad. As understood by a person of ordinary skill in the art, a keyboard or keypad is commonly used for human interaction with computers. For instance, a keyboard or keypad can be used as part of a gaming experience. Accordingly, the keyboard or keypad can be formed from a plurality of key switch mechanism 10. In other words, a keyboard or keypad is made or constructed from more than one of the key switch mechanisms 10.

The key switch mechanism 10 comprises a key cap 100, a circuit module 200 and a linking mechanism 300 comprising a positioning board 350 and a set of main links 400. The positioning board 350 has a top side 352 and a bottom side 354 opposite the top side 352. For simplicity and to aid understanding, FIG. 1A illustrates the spatial orientation of the key switch mechanism 10. The key switch mechanism 10 has a top side 12 and a bottom side 14 opposite the top side 12. In many embodiments, the top side 12 and the bottom side 14 are substantially planar.

The key switch mechanism 10 of this disclosure provides a tactile feedback to a user upon user-effectuated, user-controlled or user-directed actuation or displacement of said key cap 100. In many embodiments, the key switch mechanism 10 can be configured to provide a resistive force or resistance associated with displacement of the key cap 100. The key cap 100 includes a protrusion or actuator 130 for activation of electrical signals. The key cap 100 includes a light permeable portion 150.

The circuit module 200 comprises electronic circuitry 210, a base 220, an opening 230 and a corresponding actuator 240 coupled to a switch 242. The electronic circuitry 210 is disposed on the base 220 and is configured to provide or produce electrical signals when activated. In many embodiments, the electronic circuitry 210 is electrically coupled to a computing device for signal communication therewith. The actuator 240 is electrically coupled to the electronic circuitry 210 by way of the switch 242. By having an opening 230 on the base 220, the key switch mechanism 10 can be placed over a display screen 250. The display screen 250 is dynamic in that the images on the display screen 250 can be changed periodically or in response to user inputs. In many embodiments, the opening 230 is shaped and dimensioned such that the images on the display screen 250 are viewable through the opening 230. Having the light permeable portion 150, the key cap 100 allows a portion of the images on the display screen 250 to be viewable.

When in operation, the key switch mechanism 10 is orientated such that the top side 12 includes the positioning board 350 and the bottom side 14 includes the base 220. As shown in FIG. 1A, the positioning board 350 defines an aperture 356 shaped and dimensioned for receiving the corresponding key cap 100 therethrough. At least one clasp 360 is removably coupled to the positioning board 350. The set of main links 400 is removably coupled to the at least one clasp 360.

Figure 1B:
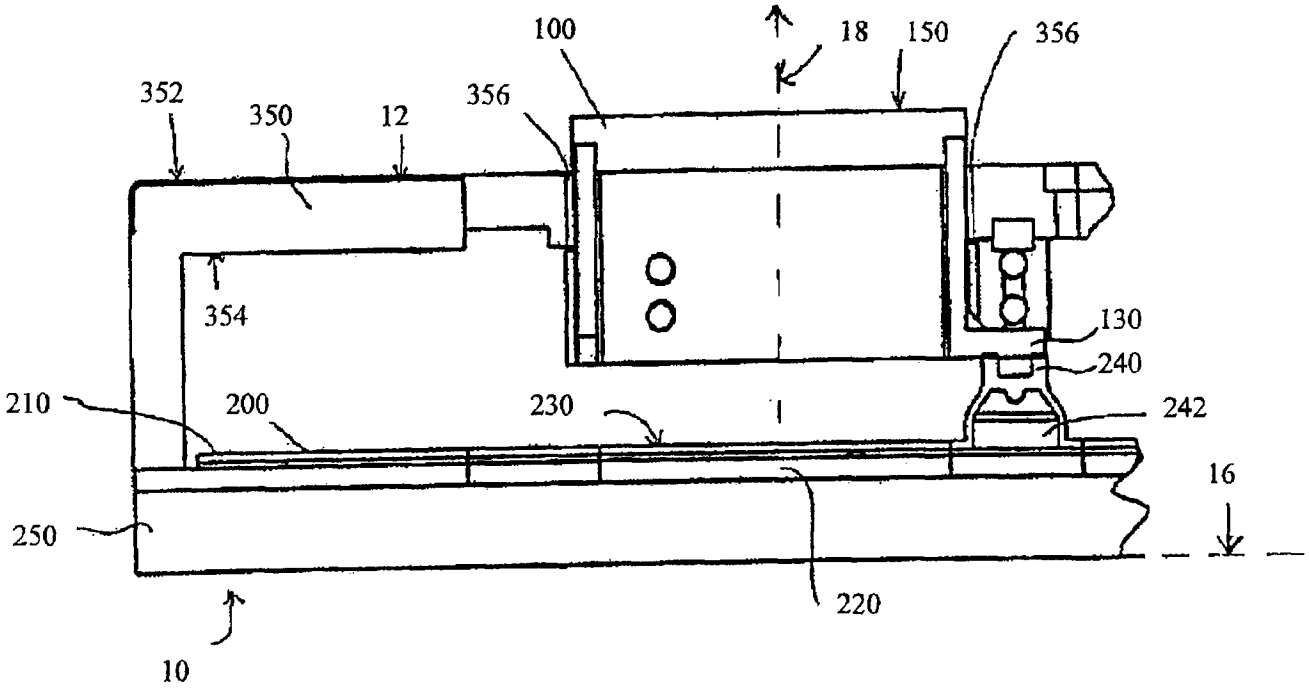
FIG. 1B shows a 2-dimensional view of the key switch mechanism on a first plane.

FIG. 1B shows a 2-dimensional view of the key switch mechanism 10 on a first plane 16. The base 220 is spatially displaced away from the positioning board 350 for accommodating any mechanism or parts of the key cap 100. The positioning board 350 defines an aperture 356 shaped and dimensioned for receiving the key cap 100. The aperture 356 is aligned with the opening 230 of the circuit module 200 such that images can be viewed through the key cap 100 by way of the light permeable portion 150. In many embodiments, each key cap 100 functions in conjunction with a corresponding opening 230. Each key cap 100 abuts a portion of the actuator 240 of the circuit module 200. When the actuator 240 is activated (i.e depressed), electrical signals are communicated to which may result in transmission of signals. As will be further discussed later, displacement of the key cap 100 displaces the protrusion 130 against the actuator 240 to activate a corresponding electrical signal by depressing (activating) the actuator 240. Displacement of the key cap 100 is along a travel axis 18 which is perpendicular or normal to the planar surface of the top side 12. The key cap 100 is pivotably displaced along the travel axis 18.

Aspects of Key Caps

Figure 2A:
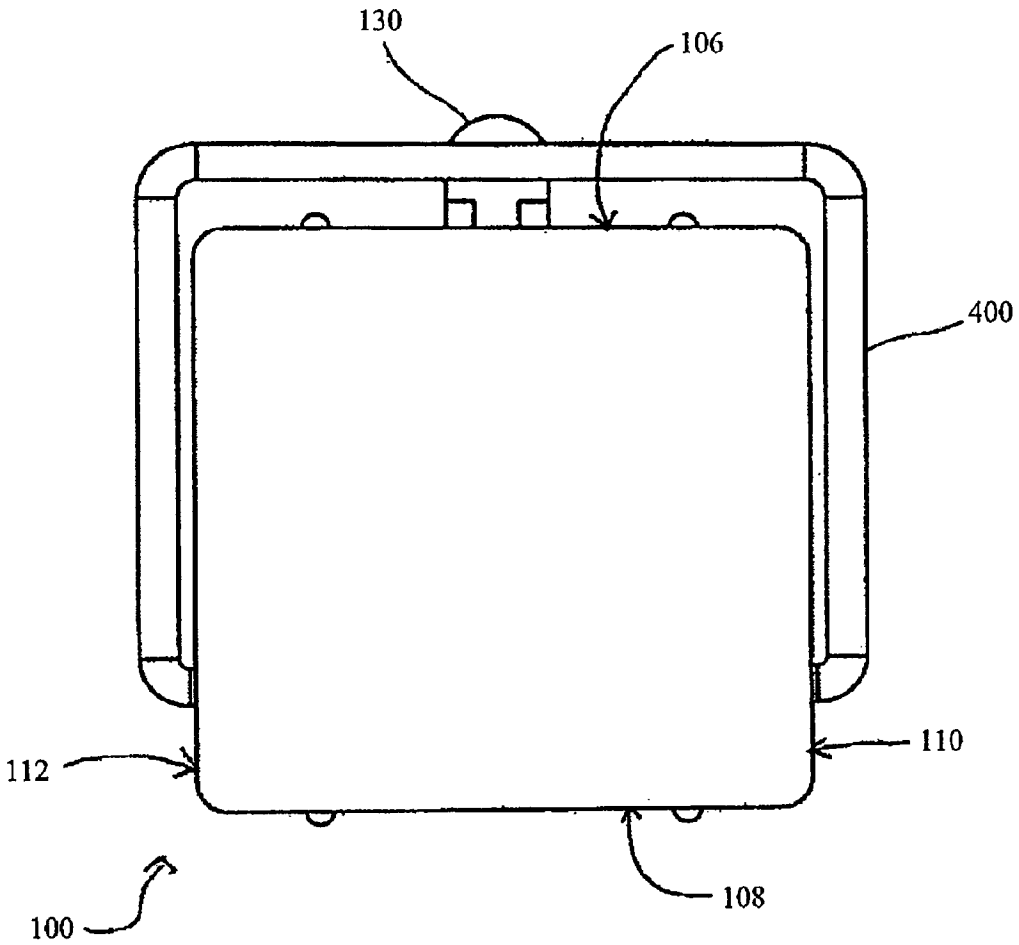
FIG. 2A is a plan view of they key cap including a top portion and a bottom portion opposite the top portion.
Figure 2B:
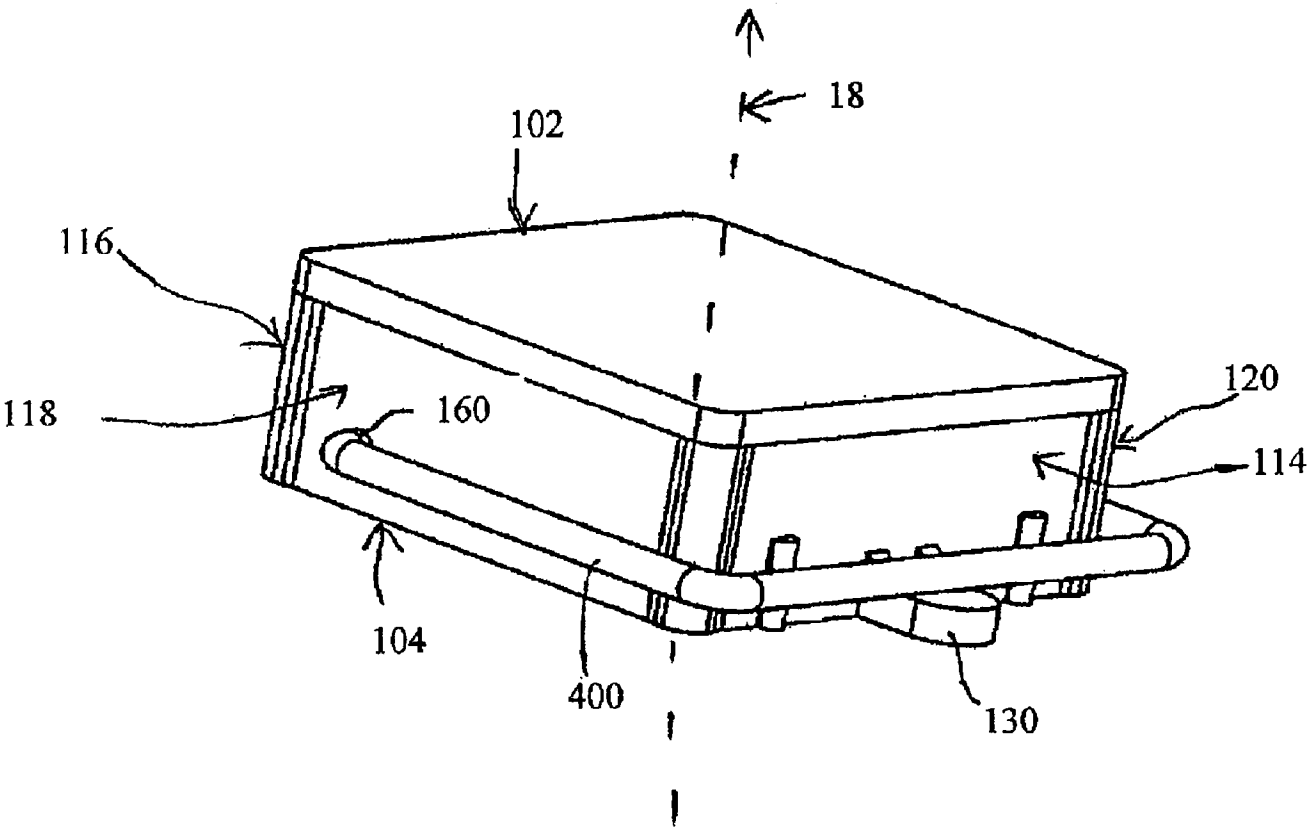
FIG. 2B is a perspective view of the key cap including a top portion and a bottom portion opposite the top portion.

FIGS. 2A and 2B show a key cap structure 100 according to some embodiments of this disclosure. For simplicity, the key cap structure 100 is referred to as a key cap 100. Specifically, FIG. 2A is a plan view and FIG. 2B is a perspective view of the key cap 100. According to various aspects of this disclosure, the key cap 100 includes a top portion 102 and a bottom portion 104 opposite the top portion 102. In many embodiments, the top portion 102 and the bottom portion 104 is a planar surface.

FIG. 2A illustrates spatial orientations defined with respect to embodiments of this disclosure. The following describes the key cap 100 having sides or edges. For simplicity, each side or edge of the key cap 100 will be referred to as a side. In some embodiments, the key cap 100 has a first side 106, a second side 108 which is disposed opposite the first side 106, and a third side 110 and a fourth side 112 extending between the first side 106 and the second side 108. The first side 106 is substantially perpendicular to the third side 110 and the fourth side 112. Accordingly, the second side 108 is perpendicular to the third side 110 and the fourth side 112. The spatial orientation of the top portion 102 is analogous to that of the bottom portion 104. Accordingly, the following description relating to the spatial orientation of each of the first, second, third and fourth sides applies to the bottom portion 104.

Each of the first side 106, second side 108, third side 110 and fourth side 112 has a corresponding wall extending therefrom the top portion 102 and the bottom portion 104 such that the first side 106, the second side 108, the third side 110, the fourth side 112 and their respective walls extending therefrom, the top portion 102 and the bottom portion 104 form a cube or a cube-like structure. To facilitate understanding and for simplicity, the wall extending from the first side 106 is referred to as a first wall 114, the wall extending from the second side 108 is referred to as the second wall 116, the wall extending from the third side 110 is referred to as the third wall 118 and the wall extending from the fourth side 112 is referred to as the fourth wall 120. The size of the key cap 100 can vary according to design specifications and user requirements.

To facilitate displacement of the key cap 100, a set of main links 400 is coupled to the key cap 100. In many embodiments, the key cap 100 defines at least one aperture 160 in the third wall 118 and at least one aperture 160 on the fourth wall 120. The apertures in the third wall 118 and the fourth wall 120 are aligned such that the set of main links 400 are held or secured in place. The apertures 160 are formed on the exterior of the third wall 118 and fourth wall 120 for pivotably coupling the set of main links 400. In some embodiments, a recess or depression is formed in place of the aperture 160, where the recess has sufficient depth to engage and/or pivot the set of main links 400.

The key cap 100 comprises a protrusion 130. In many embodiments, the protrusion 130 of each key cap 100 extends from a periphery or perimeter of the key cap 100, for example from an edge or corner of the key cap 100. For space efficiency, the protrusion 130 is dimensionally smaller than the key cap 100. In several embodiments, the protrusion 130 is of micro-range dimensions. In various embodiments, the key cap 100 comprises a protrusion 130 extending from the first wall 114 away from the interior thereof. The purpose of the protrusion 130 will be discussed further below. As will be understood by a person of ordinary skill in the art, the key cap 100 is activated when depressed or displaced from a first position to a second position about the first axis 18 which is perpendicular or normal to the planar surface of the top side 102. In various embodiments, the displacement of the key cap 100 facilitates or effectuates a corresponding displacement of the protrusion 130 for contacting at least one actuator 230 of the circuit module 200.

Figure 2C:
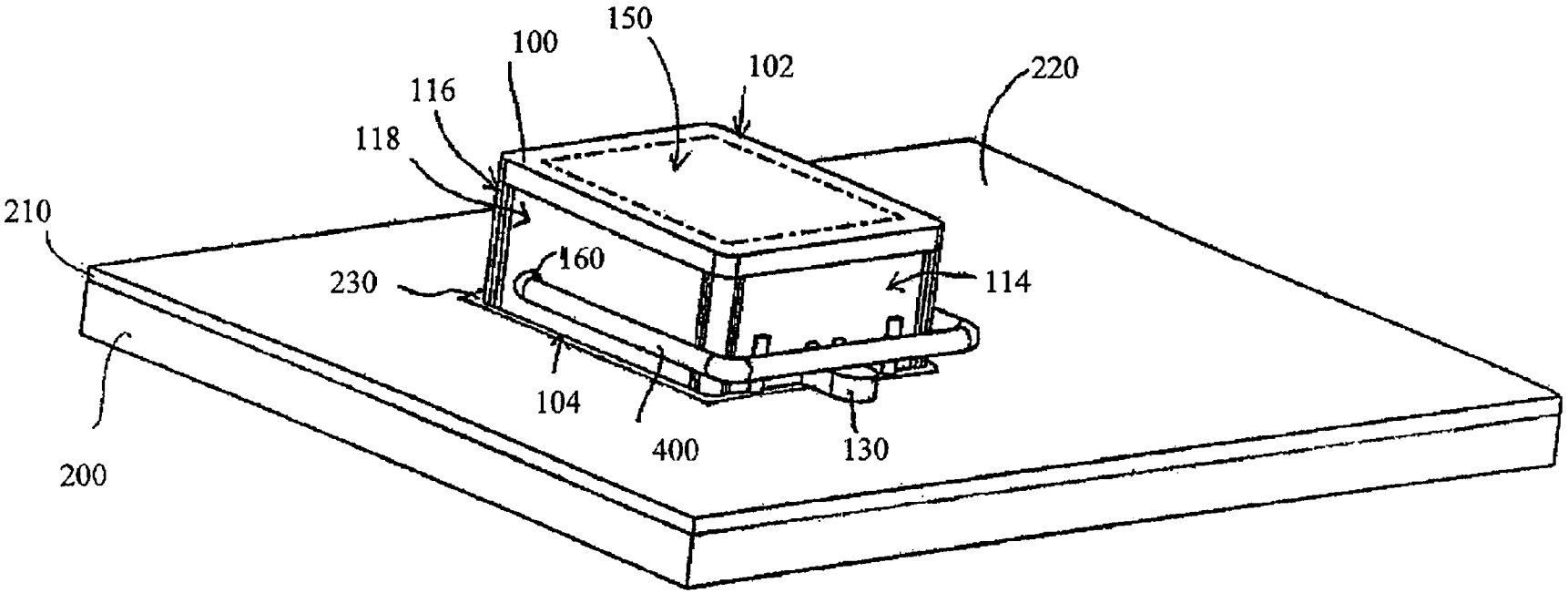
FIG. 2C shows a key cap being positioned relative to a circuit module comprising an electronic circuitry.

FIG. 2C shows a key cap 100 being positioned relative to a circuit module 200 comprising an electronic circuitry 210. The circuit module 200 includes an opening 230 in the base 220. In many embodiments, the circuit module 200 functions in conjunction with the display screen 250. The key switch mechanism 10 or circuit module 200 can be placed over the display screen 250 such that the images displayed by the display screen 250 are viewable through the opening 230. Description of the circuit module 200 is discussed below. In many embodiments, the key cap 100 is optically transmissive. The key cap 100 can include an optically transmissive or light permeable surface, region, portion, or area 150 that is configured to allow light transmission therethrough. The light permeable surface, region, portion or area 150 can be referred to as a view area or viewing window. The key cap 100 can be coupled to, disposed on, carried by, placed onto, or positioned or disposed relative to, an opening 230. By doing so, the images displayed by the display screen 250 can be projected or transmitted through the light permeable portion 150 of the key cap 100. The light permeable portion or surface 150 of the key cap 100 has a periphery that frames the light permeable portion or surface 150. Portions or areas of the display screen 250 can be viewed or seen through corresponding light permeable portion 150 of the key cap 100. The key cap 100 described in this disclosure is an optically transmissive tactile key.

Being optically transmissive, the key cap 100 facilitates light and/or light images (not shown) from the display screen 250 to permeate, filter and/or spread through the key cap 100. In many embodiments, the light permeable portion 150 includes at least 50% of the total area of the top portion 102 of the key cap 100. In some other embodiments, 100% of the total area of the top portion 102 of the key cap 100 is optically transmissive. In yet some other embodiments, at least a portion of at least one of the first wall 114, the second wall 116, the third wall 118 and the fourth wall 120 is optically transmissive.

In multiple embodiments, the protrusion 130 is shaped, dimensioned, and/or configured for minimizing obstruction or blockage of light transmission through the light permeable region 150 of the key cap 100. The position of the protrusion 130 at a periphery of, or even away from or external to, the key cap 100 can minimize, reduce, or prevent obstruction or blockage of light transmission through the light permeable region 150 of the key cap 100.

The foregoing discussion describes the structure, outlook and/or architecture of a key cap 100. It should be understood by a person of ordinary skill in the art that dependable upon design specifications, more than one key cap 100 can be deployed. This is illustrated in FIG. 2D.

Figure 2D:
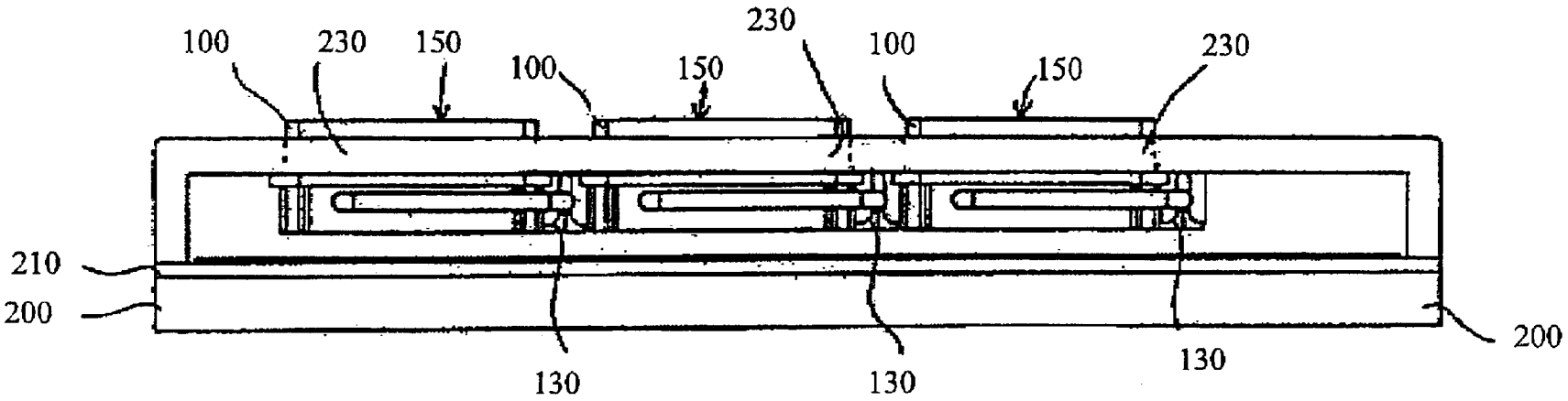
FIG. 2D shows a schematic illustration of a key switch mechanism that includes a plurality of optically transmissible tactile key caps which are coupled to, carried by, or disposed relative to a corresponding display screen that is carried by, or incorporated into, the circuit module.

FIG. 2D shows a schematic illustration of a key switch mechanism 10 that includes a plurality of optically transmissible tactile key caps 100. The optically transmissible tactile key caps 100 are coupled to, carried by, or disposed relative to a corresponding display screen 250 that is carried by, or incorporated into, the circuit module 200.

In embodiments wherein there is a plurality of key caps 100 coupled to, carried by, or disposed relative to a corresponding display screen 250, multiple portions or areas of the display screen 250 can be viewed or seen through corresponding multiple light permeable regions 150 of the key cap 100.

The key caps 100 of various embodiments supports rapid consecutive actuations or displacements (e.g., at least 50, 100, 150, or more actuations or displacements per minute) thereof for contacting corresponding actuators 240 (e.g., electromechanical switches) and generating electrical signals transmissible to the computing device. This means that the key caps 100 can be associated with a low, or very low, switch actuation latency period or duration, for example a switch actuation latency period or duration of less than approximately 2 ms, 1 ms, 0.5 ms, or less.

Aspects of the Circuit Module

Figure 3A:
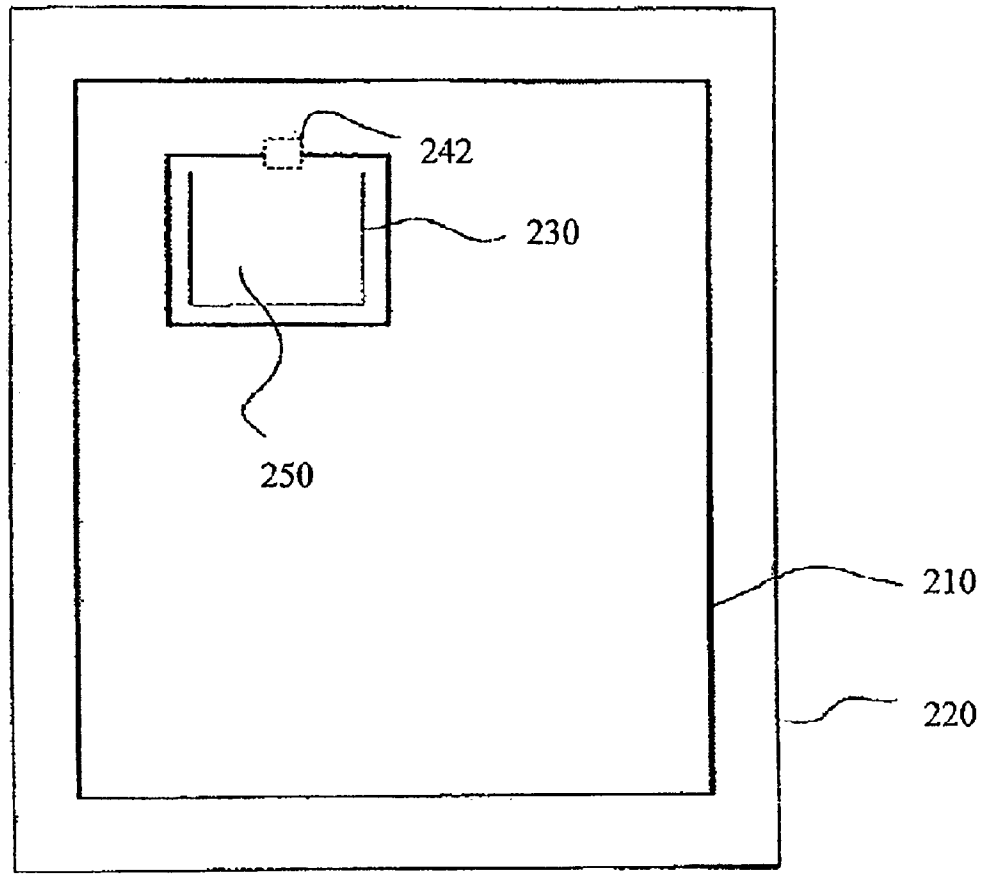
FIG. 3A shows a plan view of a base of a circuit module which defines an opening and the opening includes a corresponding switch.

FIG. 3A shows a plan view of a base 220 of a circuit module 200 according to various aspects of this disclosure. The base 220 defines an opening 230 and the opening 230 includes a corresponding switch 242. An electronic circuitry 210 is disposed on the base 220. Although the description relates to a base 220 with an opening 230 and its corresponding switch 242, it should be understood by a person of ordinary skill in the art that a base 220 can comprise a plurality of openings 230 (i.e two or more openings) with corresponding switches 242.

The opening 230 is shaped and dimensioned such that the images from a display screen 250 can be projected or transmitted through the opening 230. The display screen 250 includes one of a rigid display surface, for example an LCD or LED based display surface, and a flexible display surface, for example a polymer based display surface that is configured as an organic LED (OLED) surface. In many embodiments, the display screen 250 is referred to as an optical display surface or screen. The display screen 250 (e.g., LCD screen) is configured to dynamically display images (e.g., icons, figures, and alphanumeric characters). The display screen 250, or specific portions, areas, or regions of the display surface or screen 250, can be configured to variably display images at specific, predetermined, or different time intervals. In several embodiments, the display screen 250 is coupled to a computing system that is configured to execute stored program instructions corresponding to one or more application programs. The display screen 250 can dynamically illustrate or display images. For example, the display screen 250 can be refreshed in accordance to execution of one or more portions of the program instructions. When an electronic gaming software is executed, the display screen 250 can alter in response to user inputs.

Accordingly, the display screen 250 can be configured to variably display images depending upon one or more application programs. In several embodiments, the visual information (e.g., images, icons, text, and optical signals) displayed at different portions, regions, or areas of the display screen 250 can be dependent upon executed application program(s). The foregoing disclosure describes a key cap 100 working in conjunction with a display screen 250. It should be understood that for a key switch mechanism 10, more than one key cap 100 can be present. In many embodiments, a key cap 100 is coupled with a corresponding display screen 250.

Figure 3B:
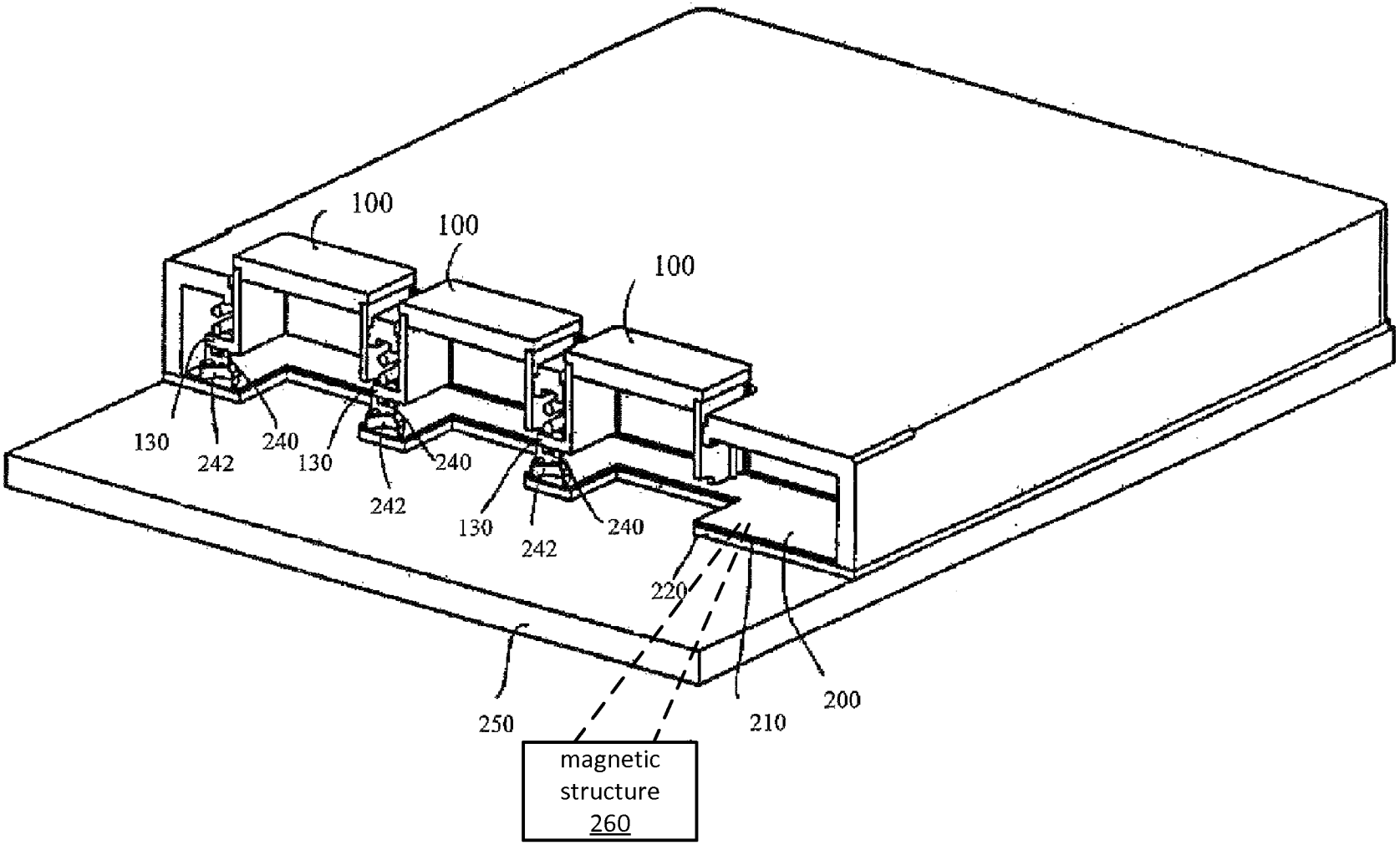
FIG. 3B shows a perspective view of a key cap with a circuit module comprising an opening with a corresponding actuator.

FIG. 3B shows a perspective view of a key cap 100 with a circuit module 200 comprising an opening 230 with a corresponding actuator 240. The protrusion 130 of the key cap 100 abuts the actuator 240. The opening 230 is positioned over the display screen 250 such that at least a portion of the images of the display screen 250 can be projected or transmitted through the opening 230. In several embodiments, the top portion 102 of the key cap 100 can be configured and/or positioned such that it can be disposed or positioned parallel, or substantially parallel, to the opening 230. By doing so, users of the key switch mechanism 10 can clearly see the images displayed by the display screen 250. The field of view defined by the key cap 100 and the light permeable portion is unblocked by the opening 230. In many embodiments, the actuator 240 is in contact with or coupled to a switch 242. The switch 242 is then electrically coupled to an electronic circuitry 210 of the circuit module 200.

Figure 3C:
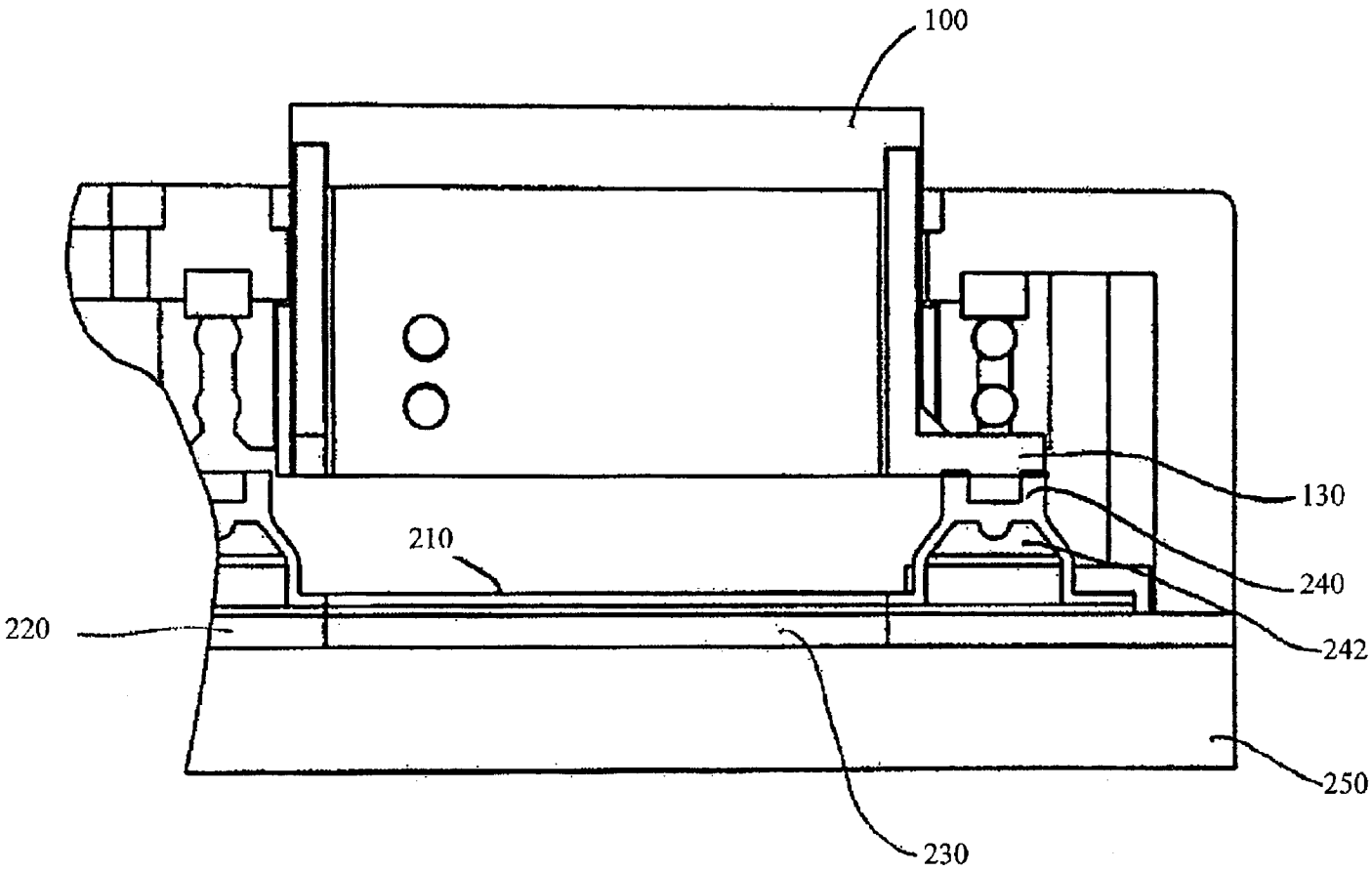
FIG. 3C shows a cross sectional side view of a key cap with a circuit module in a first position (released position).
Figure 3D:
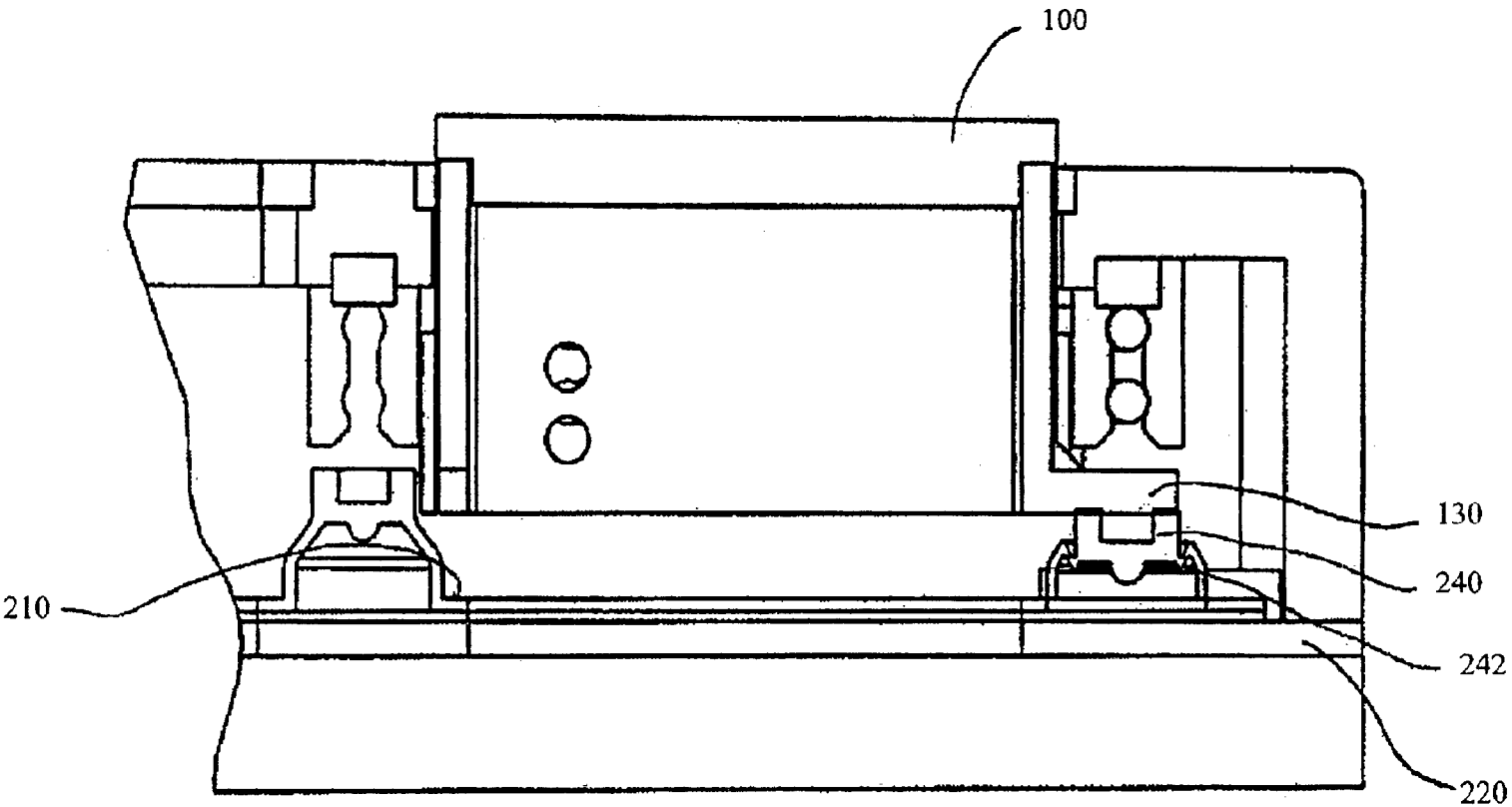
FIG. 3D shows a side view of a key cap with a circuit module in a second position (depressed position).

FIG. 3C shows a cross sectional side view of a key cap 100 with a circuit module 200 in a first position (released position) and FIG. 3D shows a side view of a key cap 100 with a circuit module 200 in a second position (depressed position) according to various aspects of this disclosure. The actuator 240 is coupled to a switch 242 which is then electrically coupled to the electronic circuitry 210 of the circuit module 200. Materials for the actuator 240 include elastomeric materials such as rubber. The actuator 240 can be one of a rubber dome, a metal dome, a leaf spring, a coil spring and an elastomeric structure. In many embodiments, the circuit module 200, in particular, the actuator 240 bias the key cap 100 towards the released position (first position) and generates a control signal when the key cap 100 is displaced to the depressed position (second position). Actuator 240 is further shaped for conveying a tactile 'click' response to a user when being depressed or actuated.

The key cap 100 of embodiments of the present disclosure includes, incorporates, carries, or is couplable to the actuator 240. The actuator 240 is then coupled to a switch 242, which is in turn electrically coupled to the electronic circuitry 210 of the circuit module 200. In many embodiments of this disclosure, each key cap 100 has a corresponding actuator 240. Each actuator 240 enables, facilitates or activates a corresponding electrical signal by way of the switch 242. The actuator 240 can be a electromechanical switch actuator or electromechanical contact element. For purposes of clarity, the actuator 240 will be described in portions of the following description as the electromechanical switch actuator or electromechanical contact element. As the actuator 240 is coupled to the electrical circuitry 210 by way of the switch 242, contact between the protrusion 130 of the key cap 100 and the actuator 240 can activate the actuator 240 and trigger generation of electrical signal(s). Many embodiments of the present disclosure provide key caps 100 that include, incorporate, or are couplable to the protrusion 130. The key cap 100 is displaceable for correspondingly displacing the protrusion 130 to thereby effectuate contact between the protrusion 130 and at least one actuator 240. The key cap 100 is also configured to provide a tactile feedback to a user associated with, or during, user-effectuated displacement of the key cap 100 and corresponding displacement of the protrusion 130.

The key cap 100 can be displaced relative to the opening 230 or display screen 250, for example between at least a first position and a second position relative to the opening 230 or the display screen 250. The second position can be located in closer proximity to the opening 230. In other words, the first position is a default position where the key cap is not depressed or activated and the second position is where the key cap 100 is in a depressed position. Accordingly, the key cap 100 is displaceable to various distances relative to the opening 230. Force (e.g., a user-controlled or user-effectuated force) applied to the key cap 100 can facilitate, or effectuate displacement of the key cap 100 instance to or towards the opening 230 (e.g., from the first position to or towards the second position relative to the display screen 250). Displacement of the key cap 100 (e.g., from the first position to, or towards, the second position) can be controlled or effectuated by a user. The resistive force provided by the key cap 100 in association with, upon, or during user-controlled or user-effectuated displacement of the key cap 100 from the first position to, or towards, the second position provides the user with a tactile feedback that is associated with the key cap 100 displacement. This tactile feedback associated with key cap 100 displacement or movement gives or provides the user with a measure of confirmation or knowledge of user's input, more specifically user-effectuated actuation or displacement of the key cap 100. The tactile feedback is facilitated by way of a linking mechanism which will be discussed later. The actuator 240 is also for biasing the key cap 100 towards the released position (first position). For example, when the key cap 100 is depressed (second position), the actuator 240 can act as a spring to bias or actuate the key cap 100 towards the released position (first position). In some embodiments, the circuit module 200 can comprise a magnetic structure 260 for repelling the key cap 100 away from the second position to thereby bias the key cap 100 towards the first position.

As discussed above, the ability for light transmission through the light permeable region 150 allows images displayed on the display screen 250 to be seen or viewed via an opening 230 by a user. More specifically, an area or portion of the display screen 250 that corresponds to (e.g., is located or disposed directly underneath) said light permeable portion, area, or surface 150 of the key cap 100 can be viewed by the user. The display screen 250 is configured to output variable images (or optical signals), for instance depending upon application program(s) executed by a computing system coupled to the display screen. Such variable images (or optical signals) output by the display screen 250 can be transmitted through the light permeable region, portion, area, or surface 150 of the key cap 100.

The light permeable region or surface 150 of the key cap 100 can be shaped, dimensioned, and/or configured to increase or maximize an area that allows light transmission through the key cap 100. Increasing the area of the light transmissible region 150 can result in, or provide, a larger area of the key cap 100 through which a user is able to view images displayed by the display screen 250.

As discussed in the foregoing disclosure, a plurality of key caps 100 can be present and for such configurations, there will be a corresponding opening 230 for each key cap 100.

The images displayed on display screen 250 are dynamically changeable or variable, for instance depending upon gaming-related scenarios occurring on a computing device (e.g., desktop or laptop computer) to which the display screen 250 is coupled to and/or based upon prior user's inputs, actuations, or selections. The display screen 250 can include or be coupled to a memory or a memory storage unit as well as appropriate display screen circuitry to facilitate or enable static and/or dynamic presentation of image data by portion(s) of the display screen 250. Image data (e.g., optical signals) output or displayed by the display screen 250, or selected portions of the display screen 250, can be selected and/or varied depending upon a set of programming instructions (e.g., corresponding to an application program, a set of device drivers, and/or firmware).

Positioning Board

Figure 4A:
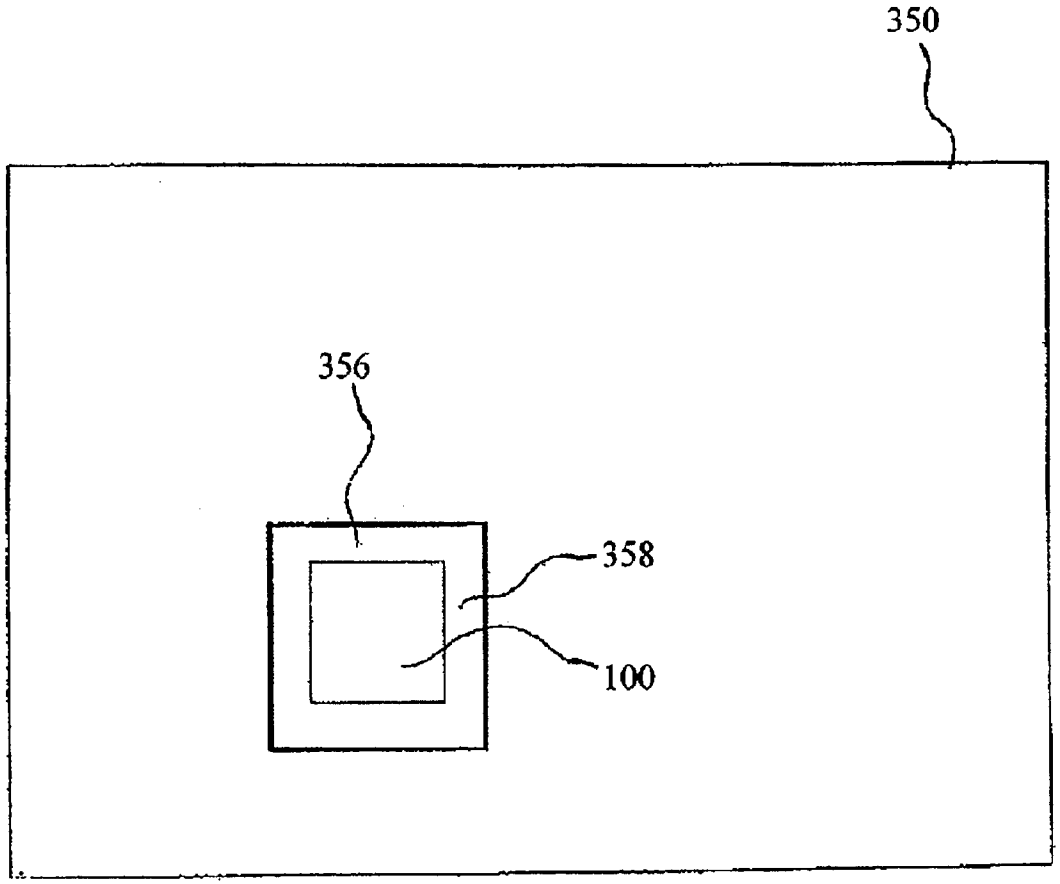
FIG. 4A shows a plan view of a positioning board with a key cap.
Figure 4B:
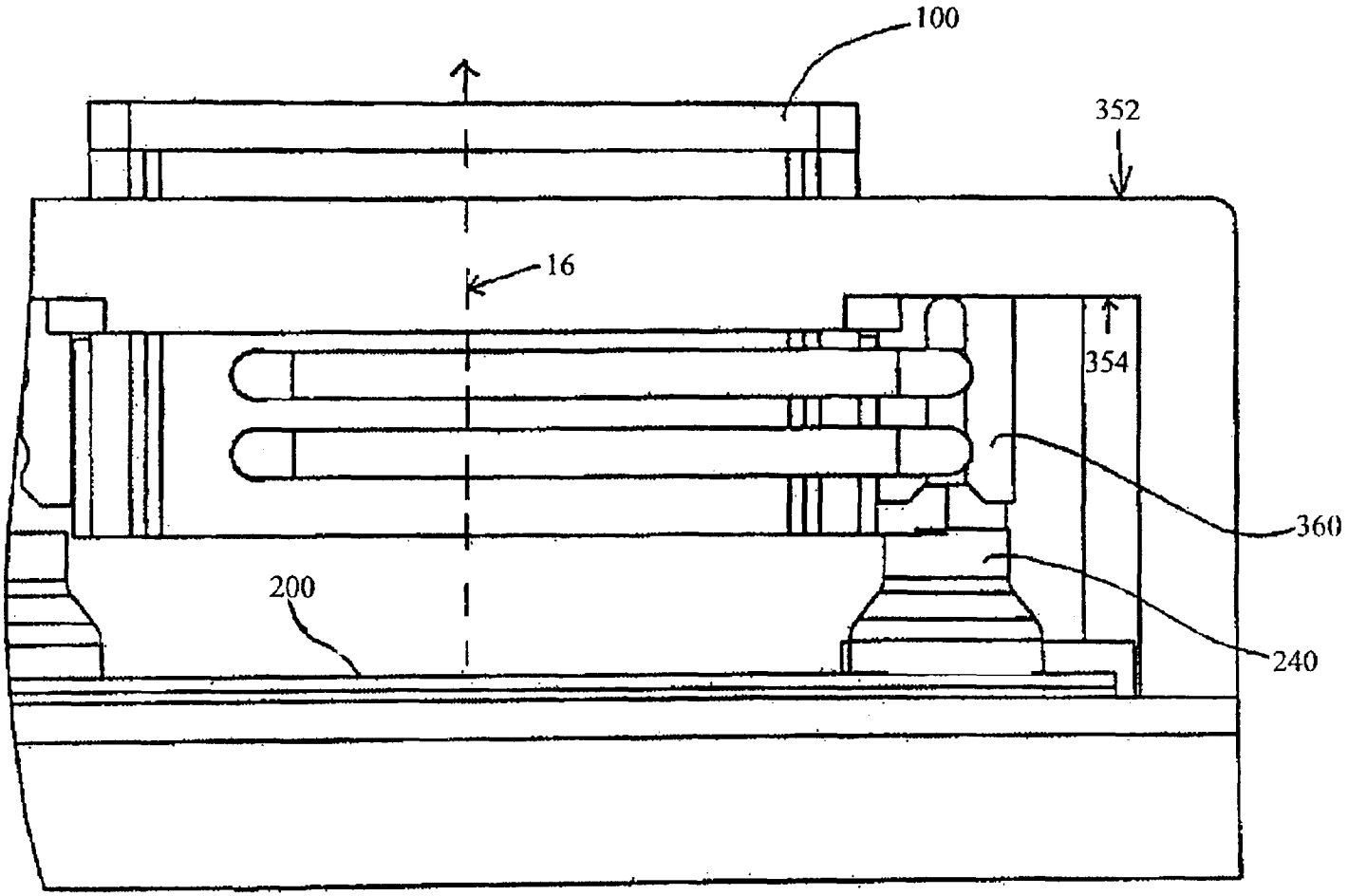
FIG. 4B shows a side view of a positioning board with a key cap.

FIGS. 4A and 4B show a positioning board 350 with a key cap 100 according to various embodiments of this disclosure. FIG. 4A is a plan view and FIG. 4B is a side view of the positioning board 350 with a key cap 100. The positioning board 350 has a top side 352 and a bottom side 354 facing away from the top side 352. Both the top side 352 and the bottom side 354 are substantially planar. The positioning board 350 can be made of at least one of polycarbonate and plastic and can have a thickness of approximately between 5 and 10 mm.

The positioning board 350 is adapted to carry or support the key cap 100. In many embodiments, the positioning board 350 is spatially displaced from the circuit module 200. The positioning board 350 serves to keep the key caps 100 in their respective positions. This can be achieved by at least one clasp 360 to pivotably hold a set of main links 400 coupled to a key cap 100 in place. In many embodiments, the at least one clasp 360 is removably coupled to the bottom side 354. This will be discussed further later. The positioning board 350 defines an aperture 356 which is shaped and dimensioned for receiving the key cap 100 therethrough. Depending upon embodiment details, the positioning board 350 can include a plurality of apertures 356. Each of the plurality of apertures 356 is shaped and dimensioned for receiving a corresponding key cap 100 therethrough. For ease of understanding and to facilitate further discussion, a positioning board 350 with each aperture 356 shaped and dimensioned for receiving a single key cap 100 is referred to as a first configuration.

As will be understood by a person of ordinary skill in the art, the key cap 100 can protrude through a corresponding aperture 356 with the top side 102 of the key cap 100 protruding above the top side 352 of the positioning board 350. By protruding the key cap 100 above the top side 352 of the positioning board 350, a user of the key switch mechanism 10 can easily depress the key cap 100. Further, the feedback experience enhances the overall gaming experience for the user. To facilitate easy depression of the key cap 100, the aperture 356 is dimensioned bigger than the corresponding key cap 100 such that a void 358 exists between the aperture 356 and the corresponding key cap 100. The void 358 can be between approximately 1-5 mm. In some embodiments, the top side 102 of the key cap 100 can be flushed with or below the top side 352 of the positioning board 350.

Figure 4C:
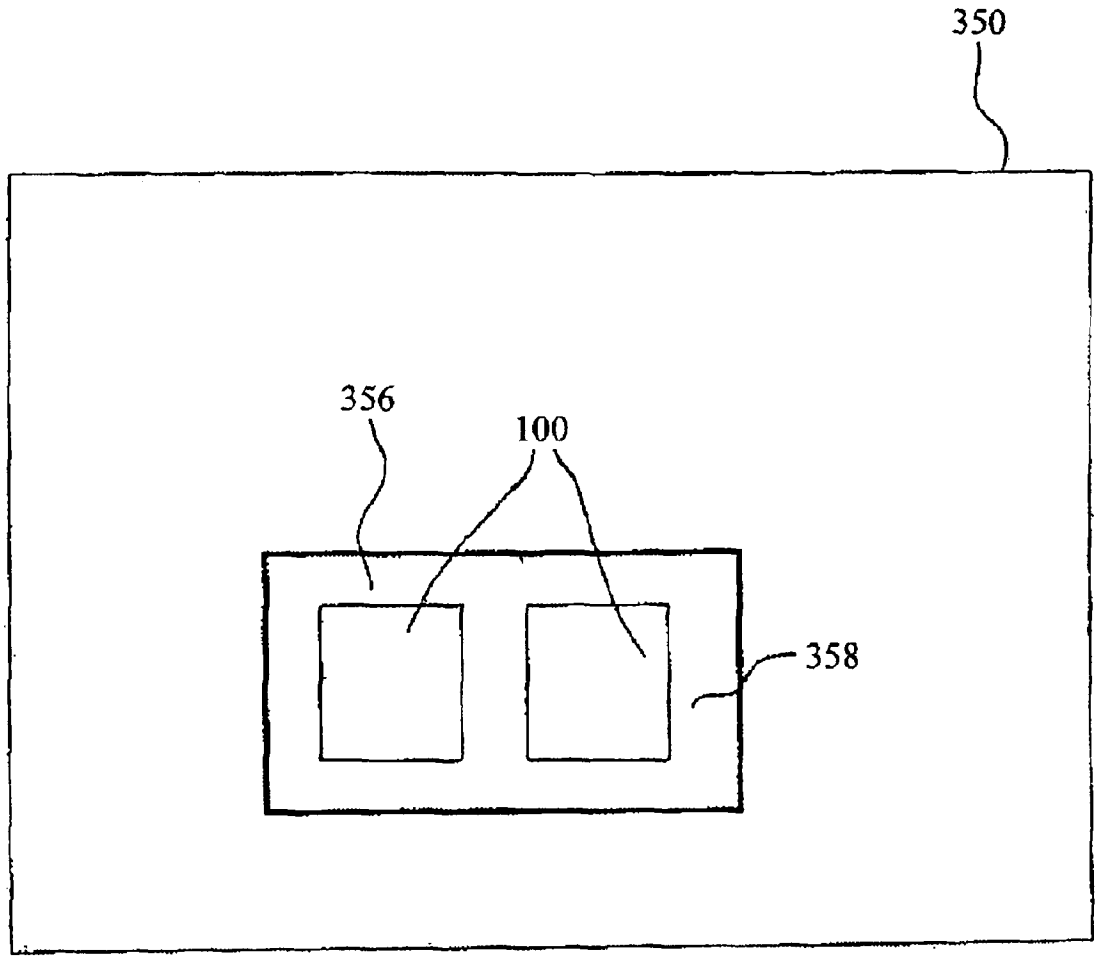
FIG. 4C shows the positioning board defining an aperture which is shaped and dimensioned for receiving two key caps.

FIG. 4C shows an embodiment of the positioning board 350 of this disclosure. The positioning board 350 defines an aperture 356 which is shaped and dimensioned for receiving two key caps 100. As will be understood by a person of ordinary skill in the art, the aperture 356 can be shaped and dimensioned to receive a plurality of key caps (i.e more than 2 key caps). Depending upon embodiment details, a positioning board 350 can have a combination of apertures 356 for single key caps 100 and apertures for a plurality of key caps 100. For ease of understanding and to facilitate further discussion, a positioning board 350 with apertures 356 shaped and dimensioned for receiving a plurality of key caps 100 is referred to as a second configuration.

Figure 4D:
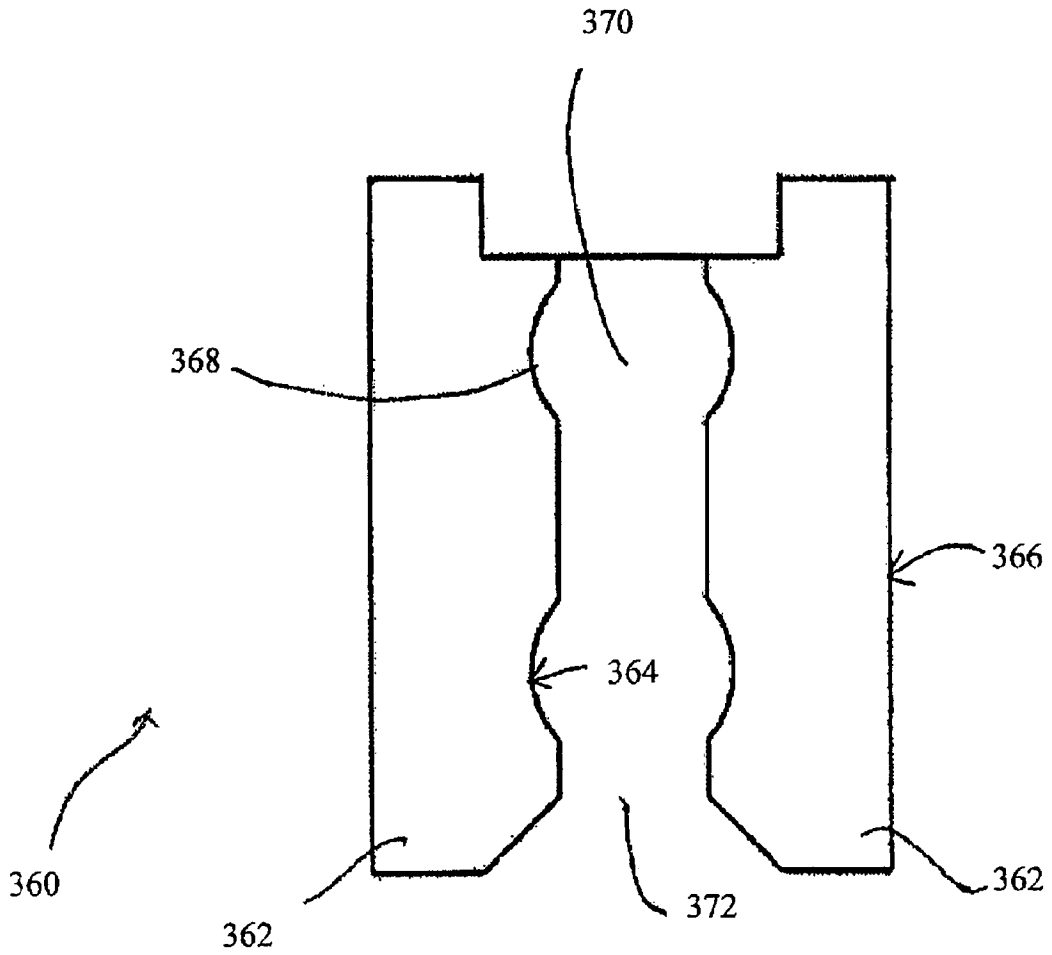
FIG. 4D is a diagram of the at least one clasp extending from the bottom side of the positioning board.

FIG. 4D is a diagram of the at least one clasp 360 according to various embodiments of this disclosure. The at least one clasp 360 extends from the bottom side 354 of the positioning board 350. The clasp 360 includes two arms 362 projecting away from the bottom side 354. Each of the arms 362 is identical. Each arm 362 has an inner surface 364 facing away from an outer surface 366 and each arm defines at least one secure portion 368 on the inner surface 364 which is shaped and dimensioned to receive the set of links 400. For simplicity, the space formed by the secure portion 368 is referred to as the secure space 370. The secure space 370 is shaped and dimensioned such that it can firmly hold and secure a portion of the set of links 400. In many embodiments, the two arms 362 can be shaped and dimensioned such that an opening 372 is defined. In many embodiments, the width of the opening 372 is smaller than that of the secure space 370. By having an opening 372 smaller in width than the secure space 370, the set of links 400 can be secured, held and/or positioned firmly by the clasp 360. As will be described later, the secure space 370 facilitates the set of links 400 to pivot freely about the secure space 370.

Linkage Mechanism

Figure 5A:
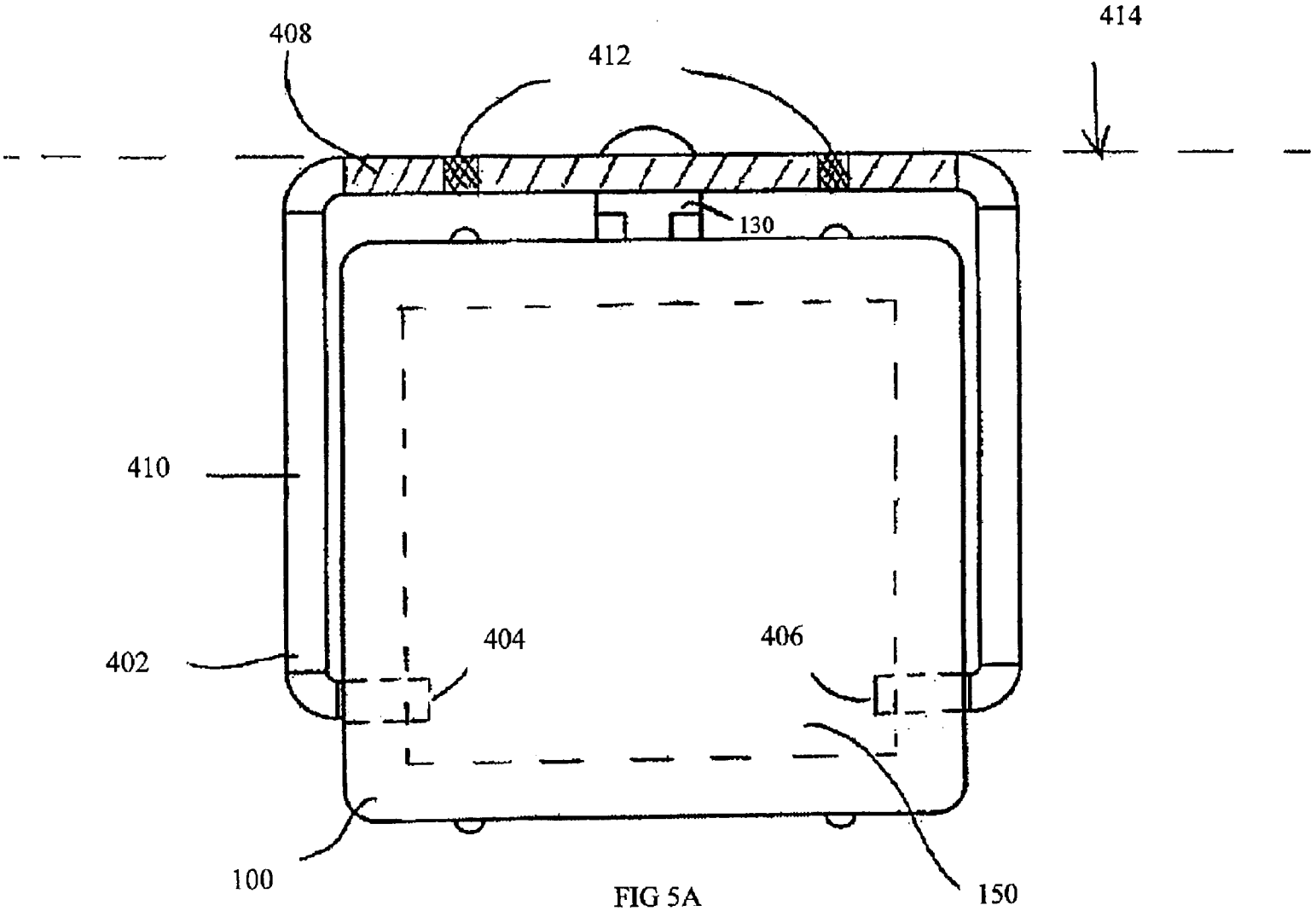
FIG. 5A shows a plan view of the key cap with the set of main links.

FIG. 5A shows a plan view of the key cap 100 with the set of main links 400. The set of main links 400 facilitates or is used for guiding travel of the key cap 100 substantially along the travel axis 18 between the depressed position (i.e second position) and the released position (i.e first position). The set of main links 400 is configured for substantially impeding tilt of the key cap 100 away from the travel axis 18 during travel of the key cap through the aperture 356 of the positioning board 350. By way of the main link(s) 400, the key cap 100 is configured to provide a resistive force or resistance to the displacement of the key cap 100 to, or towards, the display screen 250, for example from the first position to, or towards, the second position. Accordingly, the key cap 100 is configured to provide a tactile feedback to a user upon, or associated with, a user-effectuated displacement of the key cap 100. As discussed previously, the displacement of the key cap 100 can effectuate a corresponding displacement of the protrusion 130 of the key cap 100. The protrusion 130 can be displaced to or towards a corresponding actuator 240 carried by, or disposed relative to, the display screen 250. The actuator 240 is in contact or is coupled to a switch 242. The switch 242 is in turn electrically coupled to the electronic circuitry 210 of the circuit module 200. Said contact between the protrusion 130 and the switch 242 via the actuator 240 can result in generation of electrical signals, which is transmissible to a computing device and hence providing user input into said computing device.

In the following discussion, the orientation, position of the first position and the second position of the key cap 100 is analogous to that for FIGS. 3C and 3D. The set of main links 400 is configured to provide a tactile feedback to a user upon user-controlled or user-effectuated displacement or actuation of the key cap 100. The set of main links 400 can be configured and/or positioned to bias the key cap 100 at the first position and to provide a resistance or resistive force associated with a displacement of the key cap 100 from the first position to, or towards, the second position. The second position can be located at closer proximity to the display screen 250. Accordingly, the set of main links 400 can be configured to provide a resistance or resistive force associated with displacement of the key cap 100 towards the display screen 250. The set of main links can comprise one or more main links 402 (first main link, second main link etc). In embodiments where more than one main link 402 is used, the main links will be referred to as a first main, a second main link and so on.

The main link 402 can be shaped and dimensioned and/or configure to couple to the key cap 100 at or along a periphery of the key cap 100, for example, at or along at least the first wall 114, the second wall 116, the third wall 118 or the fourth wall 120 of the key cap 100. Further, the main link 402 can be shaped, dimensioned, and/or configured to couple to a number of walls of the key cap 100 such that the light permeable region 150 of the key cap 100 is located within, or substantially within, an area or perimeter defined by the main link 402. The main link 402 can be configured and/or positioned in a manner that minimizes or reduces obstruction or blockage of light transmission through the light permeable region of the key cap 100.

Essentially, the main link 402 is made of at least one of steel or other materials demonstrating similar elasticity and strength. For instance, the main link can be a rigid wire. The main link 402 has two ends, a first end 404 and a second end 406, opposite the first end 404. When the main link 402 is in use, the first end 404 substantially faces the second end 406. The first end 404 and the second end 406 of the main link 402 is inserted into an aperture 160 defined in the third wall 118 and the fourth wall 120 of the key cap 100. The diameter core of the main link 402 can be circle, square and hexangonal and can measure approximately between 1 and 2 mm.

In many embodiments, the main link 402 comprises a pivoting or medial portion 408 in between two support portions 410. The pivoting portion 408 is pivotably mounted to the positioning board 350. The pivoting portion 408 includes at least one secure portion 412 which is secured by the clasp 360 of the positioning board 350. A pivot axis 414 is defined at, or through the pivoting portion 408 of the main link 402. In many embodiments, the pivot portion 408 is located along the perimeter of the key cap 100 (i.e along the first wall 114 of the key cap 100). The secure portion 412 acts as a pivoting point along the pivot axis 414 where during movement of the key cap 100 from a first position to a second position or vice versa, the displacement of the key cap 100 from a first position to the second position is facilitated by the pivoting of the secure portion 412. In some embodiments, the main link 402 comprises two or more separate portions. For instance, each secure portion 412 of each main link 402 is separate from another secure portion 412 of the same said main link 402.

The pivoting portion 408 is located away from or external of the light permeable portion 150 of the key cap 100. The location of the light permeable portion 150 away from the pivoting portion 408 minimizes or reduces obstruction caused by the pivoting portion 408 to light transmission through the light permeable region 150.

User-effectuated displacement of the key cap 100 (e.g., by a user applied force onto the key cap 100) can facilitate or effectuate a corresponding displacement of the main link 402, more specifically a pivot or rotation of at least a portion of the main link 402 about the pivot axis 414. The key cap 100 can be pivoted or rotated about the pivot axis 414 upon user-effectuated displacement of the key cap 100. The displacement, more specifically pivot or rotation, of the key cap 100 about the pivot axis 414 can effectuate displacement of the key cap 100 from the first position to or towards the second position. Displacement, more specifically pivot or rotation, of the key cap 100 from the first position to the second position can trigger or result in an actuation or activation of an actuator 240 that is coupled to, carried by, or disposed relative or adjacent to, the display screen 250.

The actuator 240 is in contact or coupled to the switch 242 which is electrically coupled to the electronic circuitry 210 of the circuit module 200. By displacing the key cap 100 to the second position, the protrusion 130 of the key cap 100 activates the switch 242 by way of the actuator 240. In many embodiments, the displacement, more specifically pivot or rotation, of the key cap 100 displaces the protrusion 130 and effectuates contact between the protrusion 130 and the switch 242 by way of the actuator 240. The actuator 240 is coupled to, carried by, or disposed relative or adjacent to, the display screen 250. The contact between the 130 and the actuator 240 causes or triggers actuation of the switch 242 and thereby causes a generation of electrical signal(s) and transmission of generated electrical signal(s) to a computing device that is coupled to the switch 242.

Figure 5B:
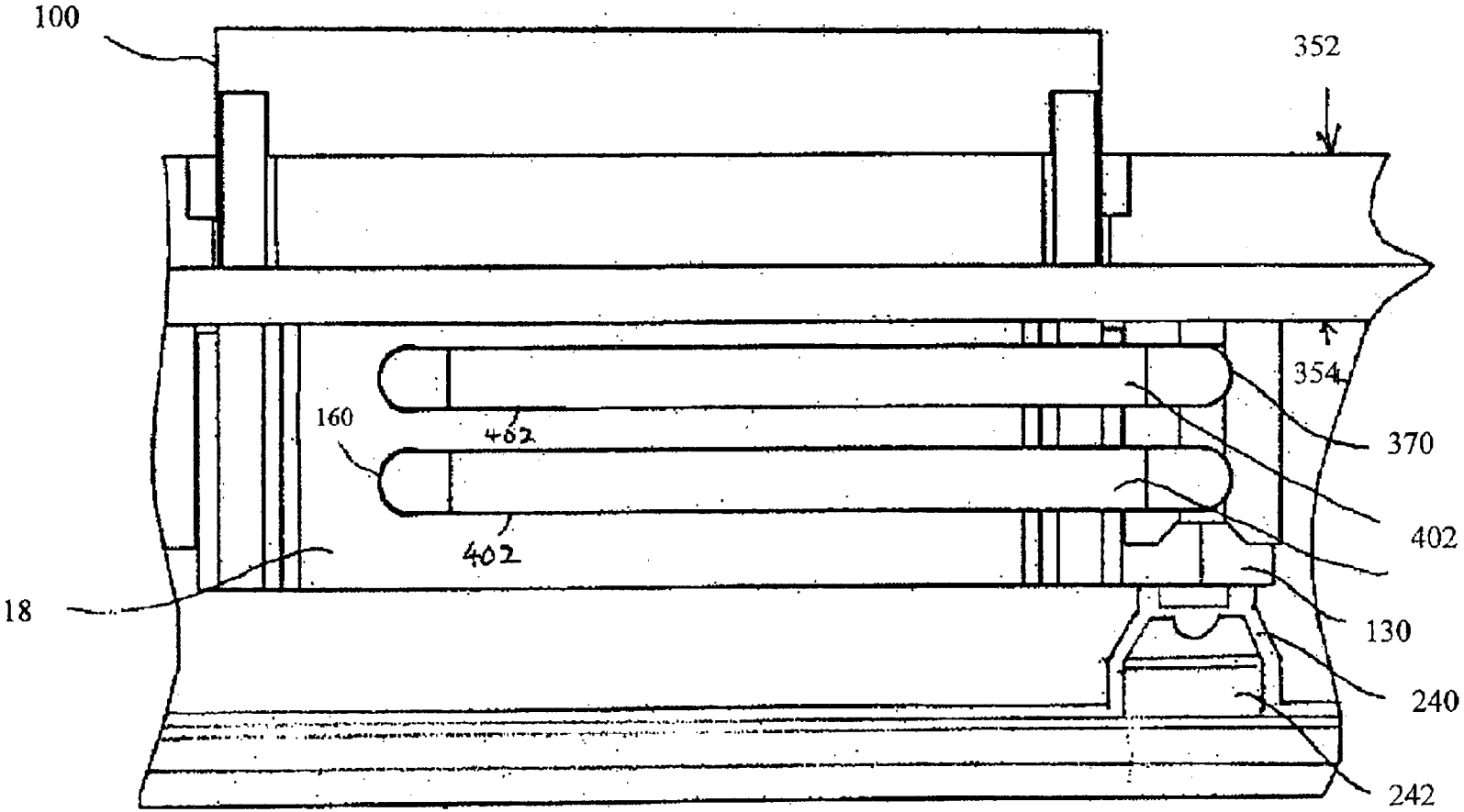
FIG. 5B shows a side view of a key cap in a first position being secured to the clasp of the positioning board by way of two main links.
Figure 5C:
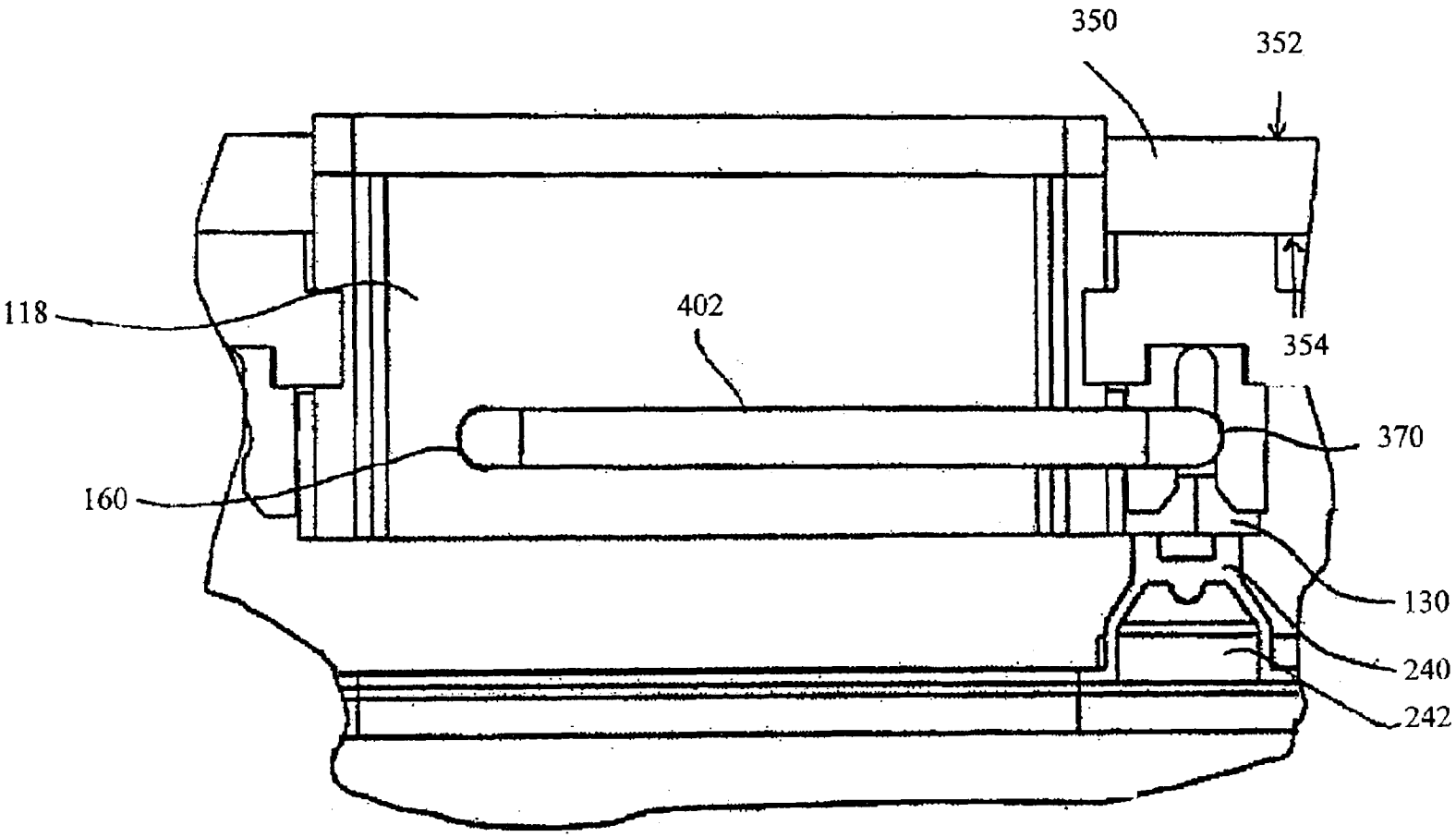
FIG. 5C shows a side view of a key cap in a first position being secured to the clasp of the positioning board by way of one main link.

FIGS. 5B and 5C show a side view of a key cap 100 in a first position being secured to the clasp 360 of the positioning board 350 by way of the main link(s) 402. As shown in FIGS. 5B and 5C, the protrusion 130 of the key cap 100 is being disposed between the clasp 360 and the actuator 240. Depending upon embodiment details, each key cap 100 can be supported or secured by one or two main links 402. FIG. 5B shows a side view of a key cap 100 where two main links 402 (a first main link and a second main link) are used and FIG. 5C shows a side view of a key cap 100 where a single main link 402 is used. It will be understood by a person of ordinary skill in the art that for a key cap 100 with one main link 402 (FIG. 5C), the first configuration (see description for FIGS. 4A and 4B) will be more suitable. For a key cap 100 with two main links 402 (FIG. 5B), the second configuration will be suitable as more support is provided by the second main link 402 to keep the key cap 100 in place. Analogous to the first main link, the second main link is pivotably coupled to the positioning board 350 and the exterior of the side wall of the key cap 100. The first main link and the second main link being in a parallel configuration with the key cap 100 for further impeding tilt of the key cap 100 from the travel axis 18.

The main links 402 are secured to the positioning board 350 by way of the clasp 360. Each end of the main link(s) 402 is inserted into a corresponding aperture 160 of the key cap 100. As shown in FIG. 5B each of the two main link(s) 402 is substantially parallel to each other. By having two main links 402, the key cap 100 is firmly secured during displacement of the key cap 100 from the first position (released position) to the second position (depressed position).

Figure 5D:
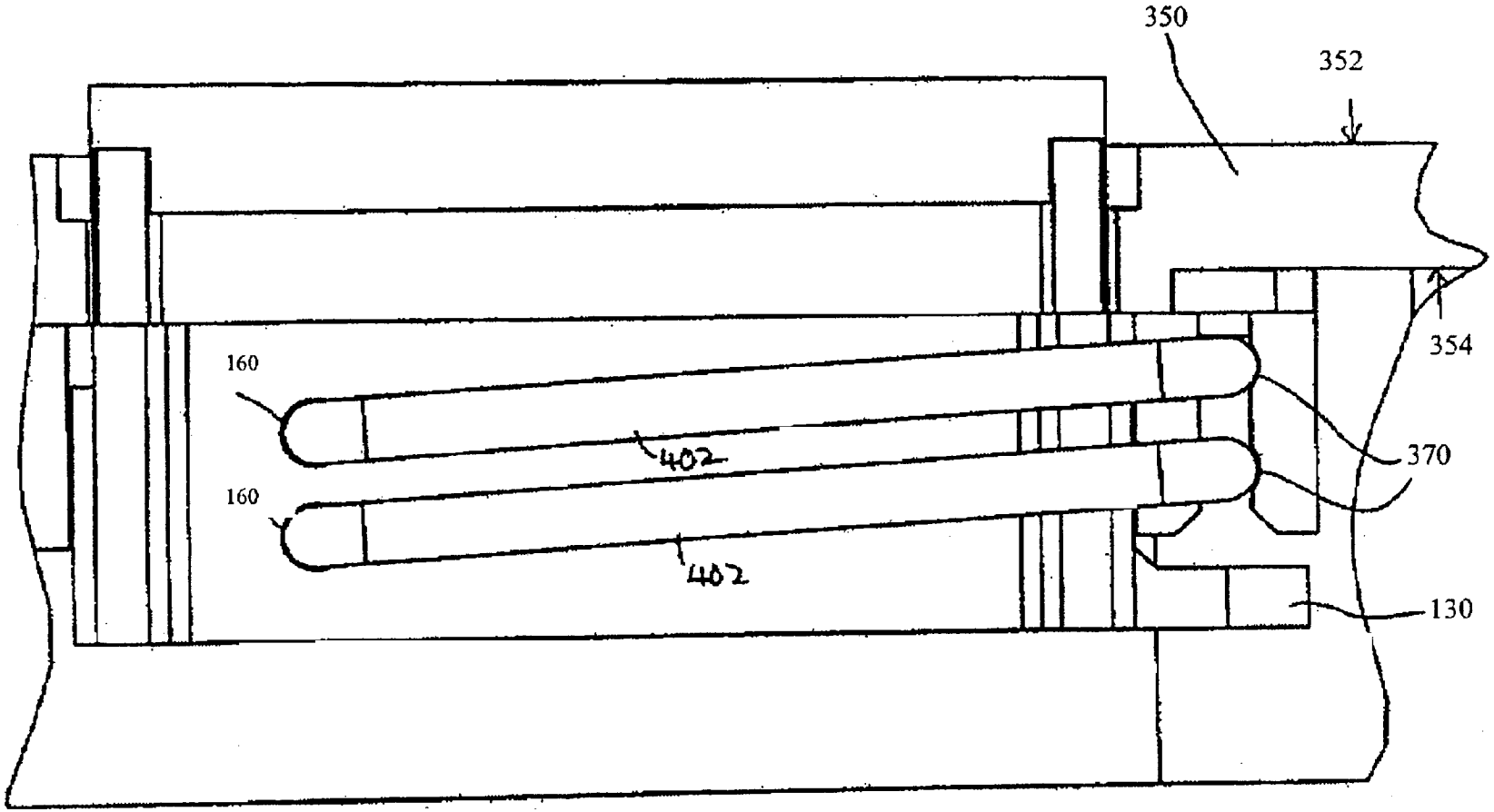
FIG. 5D is a side view of the key cap in a second position.

FIG. 5D is a side view of the key cap 100 of FIG. 5B in a second position. In a first position shown in FIG. 5B, the main links 402 is substantially parallel to the third side 110 of the key cap 100. When in the second position, each of the main links 402 is displaced at approximately 45 degrees towards the second position with respect to the first position.

Figure 6A:
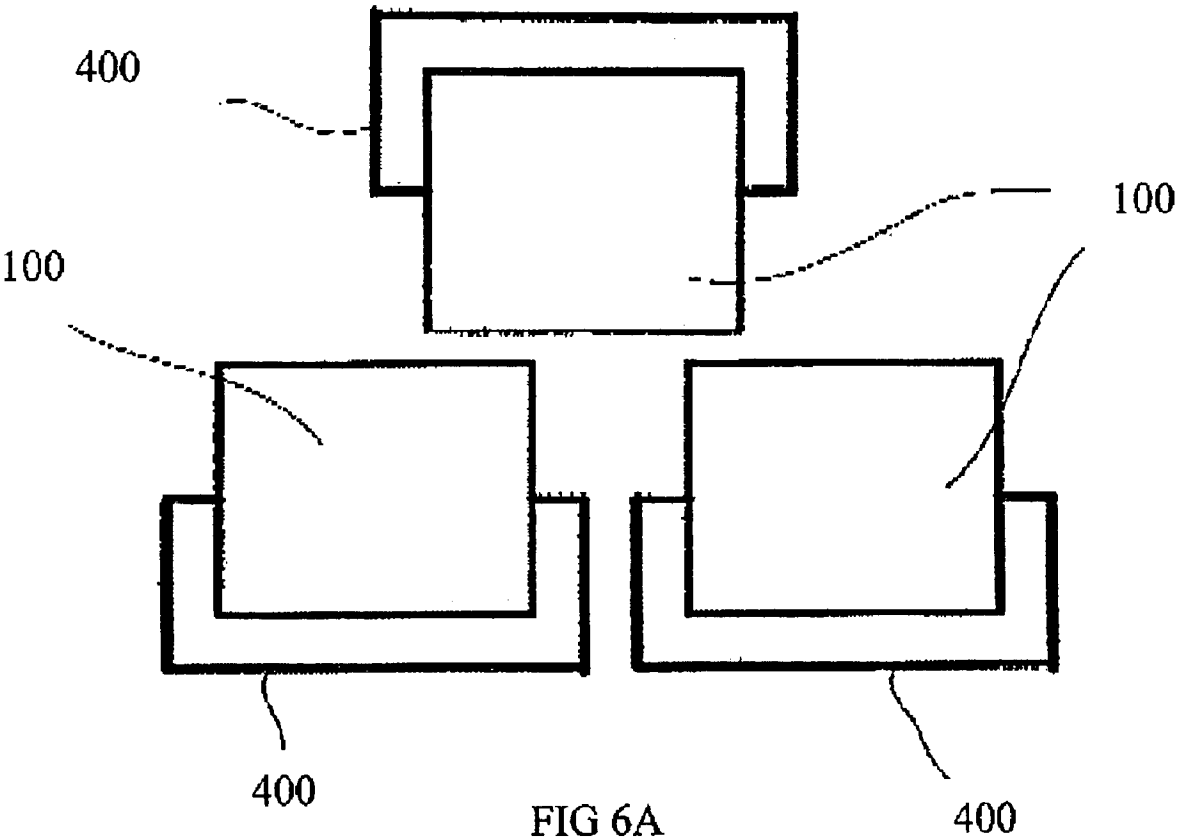
FIG. 6A shows key caps being arranged in a staggered array configuration.
Figure 6B:
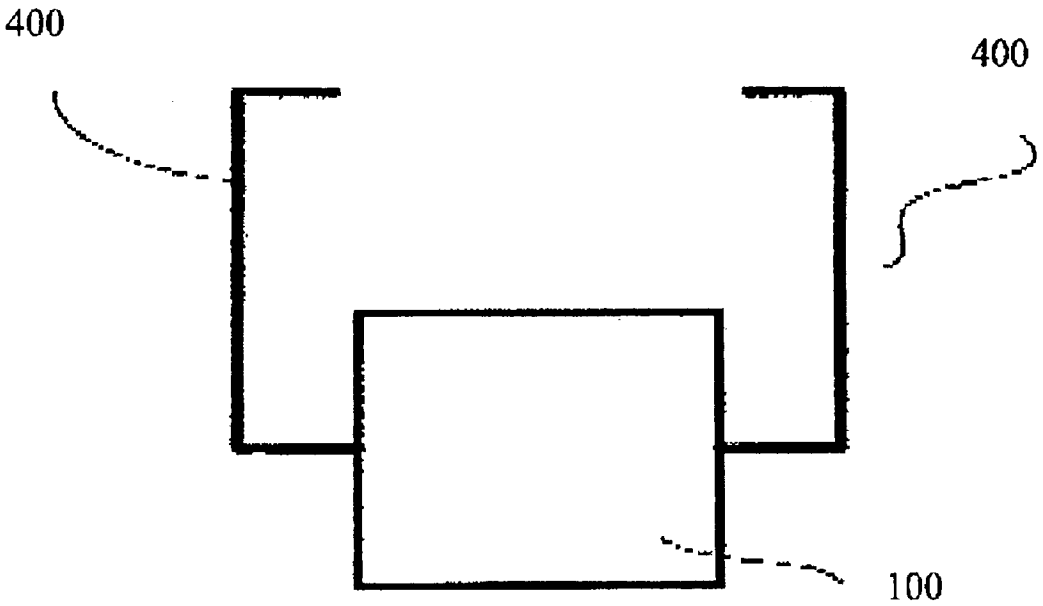
FIG. 6B shows a cantilever key cap mechanism which includes a key cap and two arms.

FIG. 6A shows key caps 100 of this disclosure arranged in a staggered array configuration. The set of main links 400 provides space efficiency in the arrangement of the key caps 100. For instance, the set of main links 400 allows the key cap 100 to be arranged in a staggered array configuration which cannot be achieved in other key switch mechanism concepts such as a cantilever concept. FIG. 6B shows a cantilever key cap mechanism 500 which includes a key cap 502 and two arms 504. As shown in FIG. 6B, the two arms 504 extend outwards and away from the key cap 502. A staggered array configuration is not operable with the cantilever key cap mechanism 500 as the arms may obstruct the other adjacent key caps.

Application of the Key Switch Mechanism

The key switch mechanism 10 according to several embodiments of this disclosure can be utilized in a number of ways. For instance, the key switch mechanism 10 can function as a key switch for a display. In some other applications, a plurality of key switch mechanism 10 can combine to form a keyboard or keypad. Alternatively, the key switch mechanism 10 can form part of a handheld device.

The key switch mechanism 10 and in particular, the circuit module 200 can be coupled to a computing system that includes a processor and a memory. The computing system is configured to execute stored program instructions corresponding to one or more application programs. Based upon application program execution, context, status or state, visual information (e.g., images, icons, text, and optical signals) can be generated or retrieved and directed to one or more portions, areas, or regions of the display screen 250. For example, in a gaming environment where a gaming application is executed, visual information displayed at specific portions, areas, or regions of the display screen 250 can be dependent upon the execution, context, status, or state of the application program.

Thus, there has been shown and discussed various embodiments of a key switch mechanism which fulfils the objectives and advantages sought thereof. Many changes, modifications, variations, and other uses and applications of the subject disclosure will, however, become apparent to those skilled in the art after considering this specification together with the accompanying figures and claims. All such changes, modifications, variations and other uses and applications which do not depart from the spirit and scope of the key switch mechanism of this disclosure are deemed to be covered by embodiments of this disclosure which is limited only by the claims which follows.

In the foregoing manner, various embodiments of the disclosure are described for addressing at least one of the foregoing disadvantages. Such embodiments are intended to be encompassed by the following claims, and are not to be limited to specific forms or arrangements of parts so described and it will be apparent to one skilled in the art in view of this disclosure that numerous changes and/or modification can be made, which are also intended to be encompassed by the following claims.

The invention claimed is:

1. A key switch mechanism comprising a circuit module, a key cap having a top portion and a side wall extending therefrom, and a linkage mechanism for guiding travel of the key cap substantially along a travel axis between a depressed position and a released position, the linkage mechanism comprising:

a positioning board spatially displaced from the circuit module, the positioning board defining an aperture shaped and dimensioned for receiving the key cap therethrough; and a main link pivotably coupled to the positioning board, the main link further being pivotably coupled to the exterior of the side wall of the key cap, the main link for substantially impeding tilt of the key cap away from the travel axis during travel of the key cap through the aperture of the positioning board, wherein the circuit module biases the key cap towards the released position and generates a control signal when the key cap is displaced to the depressed position.

2. The key switch mechanism as in claim 1, the top portion of the key cap being light permeable.

3. The key switch mechanism as in claim 1, the main link being a rigid wire comprising two ends terminating in corresponding two apertures defined in the side wall of the key cap, the two apertures being shaped and inter-aligned for pivoting of the main link thereabout.

4. The key switch mechanism as in claim 3, the main link further comprising a medial portion being pivotably mounted to the positioning board.

5. The key switch mechanism as in claim 1, the linkage mechanism further comprising a second main link pivotably coupled to the positioning board and the exterior of the side wall of the key cap, the main link and the second main link being in a parallel configuration with the key cap for further impeding tilt of the key cap from the travel axis.

6. The key switch mechanism as in claim 1, the circuit module comprising a magnetic structure for repelling the key cap away from the depressed position to thereby bias the keycap towards the released position.

7. The key switch mechanism as in claim 1, the circuit module comprising an actuator for biasing the key cap towards the released position.

8. The key switch mechanism as in claim 7, the actuator being one of a rubber dome, a metal dome, a leaf spring, a coil spring and an elastomeric structure.

9. The key switch mechanism as in claim 7, the key cap further comprising a protrusion extending from the side wall away from the interior thereof, the protrusion abutting the actuator.

10. The key switch mechanism as in claim 9, the positioning board comprising a clasp where within the main link is received for pivot coupling thereto, the protrusion of the key cap being disposed between the clasp and the actuator.

* * * * *